US009226575B2

(12) United States Patent
Crowley

(10) Patent No.: US 9,226,575 B2
(45) **Date of Patent: *Jan. 5, 2016**

(54) SUPPORT APPARATUS

(71) Applicant: Quick-Sling, LLC, Taunton, MA (US)

(72) Inventor: William J. Crowley, East Freetown, MA (US)

(73) Assignee: Quick-Sling, LLC, Taunton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/567,681

(22) Filed: Dec. 11, 2014

(65) Prior Publication Data

US 2015/0090846 A1 Apr. 2, 2015

Related U.S. Application Data

(63) Continuation-in-part of application No. 13/866,754, filed on Apr. 19, 2013, now Pat. No. 9,010,553, which is a continuation-in-part of application No. 13/274,763, filed on Oct. 17, 2011, now Pat. No. 8,827,232, which is a continuation-in-part of application No. 13/006,316, filed on Jan. 13, 2011, now Pat. No. 8,701,261.

(51) Int. Cl.

| | |
|---|---|
| ***A47B 43/00*** | (2006.01) |
| ***F16M 13/02*** | (2006.01) |
| ***F24F 13/32*** | (2006.01) |

(52) U.S. Cl.

CPC ..... *A47B 43/003* (2013.01); *F16M 13/022* (2013.01); *F16M 13/027* (2013.01); *F24F 13/32* (2013.01); *Y10T 29/49826* (2015.01)

(58) Field of Classification Search

CPC . A47B 43/003; F16M 13/022; F16M 13/027; F24F 13/32; Y10T 29/49826

USPC ..... 211/27, 187, 189; 29/897.31, 525.11, 29/525.14; 312/351.1, 351.7; 52/653.1, 52/664, 299, 126.5; 248/688, 676, 678, 248/346.01, 346.03, 158, 163.1, 188.1, 248/188.8

See application file for complete search history.

(56) References Cited

U.S. PATENT DOCUMENTS

| | | | | | |
|---|---|---|---|---|---|
| 685,689 | A | * | 10/1901 | Millikan | 211/27 |
| 867,661 | A | * | 10/1907 | Keating | 211/27 |
| 1,577,842 | A | * | 3/1926 | Murphy | 248/163.1 |
| 1,872,525 | A | * | 8/1932 | Taylor | 312/351.7 |
| 1,889,811 | A | * | 12/1932 | Richardson | 312/195 |
| 2,905,232 | A | * | 9/1959 | Umphred, Jr. et al. | 248/188.1 |
| 2,992,001 | A | * | 7/1961 | Ferris, Jr. | 52/126.5 |
| 3,190,208 | A | * | 6/1965 | Styne et al. | 454/296 |
| 3,493,201 | A | * | 2/1970 | Marran | 248/678 |
| 3,494,478 | A | | 2/1970 | Link | 211/85.19 |

(Continued)

OTHER PUBLICATIONS

Diamond Storage Concepts LLC, HyLoft Storage Unit #00808 Installation Instructions (date unknown).

(Continued)

*Primary Examiner* — Joshua J Michener
*Assistant Examiner* — Devin Barnett
(74) *Attorney, Agent, or Firm* — McLane Middleton, Professional Association

(57) ABSTRACT

A modular stand system is adjustable in the transverse direction and height and is adapted for HVAC system components that need to be elevated above a support surface. In certain embodiments, the modular stand systems herein are advantageously used to support HVAC variable refrigerant flow (VRF) units.

14 Claims, 29 Drawing Sheets

(56) References Cited

U.S. PATENT DOCUMENTS

| | | | | | |
|---|---|---|---|---|---|
| 3,498,654 | A | * | 3/1970 | Diaz et al. | 52/653.2 |
| 3,540,175 | A | * | 11/1970 | Hawn | 52/126.6 |
| 3,575,366 | A | * | 4/1971 | Blum et al. | 248/678 |
| 3,862,464 | A | * | 1/1975 | Arens | 15/217 |
| 3,955,511 | A | | 5/1976 | Bak | 108/137 |
| 4,194,325 | A | * | 3/1980 | Chalpin, Jr. | 52/14 |
| 4,348,843 | A | * | 9/1982 | Cairns et al. | 52/167.1 |
| 4,630,550 | A | * | 12/1986 | Weitzman | 108/155 |
| 4,657,442 | A | * | 4/1987 | Krings | 405/282 |
| 4,682,453 | A | * | 7/1987 | Holmgren | 52/126.2 |
| 4,741,445 | A | * | 5/1988 | Klein | 211/192 |
| 4,899,497 | A | * | 2/1990 | Madl, Jr. | 52/126.6 |
| 4,910,932 | A | * | 3/1990 | Honigman | 52/280 |
| 5,050,358 | A | * | 9/1991 | Vladislavic | 52/334 |
| 5,067,685 | A | * | 11/1991 | Johnston, Jr. | 248/676 |
| 5,308,037 | A | * | 5/1994 | Gonzalez | 248/670 |
| 5,407,171 | A | * | 4/1995 | Gonzalez | 248/670 |
| 5,442,885 | A | * | 8/1995 | Laven et al. | 52/844 |
| 5,603,187 | A | * | 2/1997 | Merrin et al. | 52/58 |
| 5,741,030 | A | | 4/1998 | Moore et al. | |
| 5,820,092 | A | * | 10/1998 | Thaler | 248/237 |
| D416,152 | S | | 11/1999 | Payne et al. | |
| 6,141,927 | A | * | 11/2000 | Usui | 52/263 |
| 6,290,073 | B1 | * | 9/2001 | Barnes et al. | 211/60.1 |
| 6,409,031 | B1 | | 6/2002 | Wynne | |
| D459,926 | S | | 7/2002 | Mikich et al. | |
| 6,435,105 | B1 | | 8/2002 | Mikich et al. | |
| D470,353 | S | | 2/2003 | Mikich et al. | |
| 6,715,427 | B2 | | 4/2004 | Mikich et al. | |
| 6,719,247 | B1 | | 4/2004 | Botting | |
| 6,772,564 | B2 | * | 8/2004 | Leon | 52/126.5 |
| 6,866,579 | B2 | | 3/2005 | Pilger | |
| 6,976,663 | B1 | * | 12/2005 | Faulk | 248/688 |
| 7,037,030 | B2 | * | 5/2006 | McLemore | 404/6 |
| 7,083,151 | B2 | | 8/2006 | Rapp | |
| 7,152,535 | B2 | | 12/2006 | Mikich et al. | |
| 7,174,686 | B1 | * | 2/2007 | Legband | 52/471 |
| 7,261,256 | B2 | | 8/2007 | Pattie et al. | |
| 7,410,335 | B2 | | 8/2008 | Scott et al. | 410/130 |
| 7,506,593 | B2 | * | 3/2009 | Strabel, III | 108/156 |
| 7,596,962 | B2 | | 10/2009 | Karamanos | |
| 8,011,156 | B1 | * | 9/2011 | Schwan | 52/653.1 |
| 8,245,651 | B1 | | 8/2012 | Mikich et al. | |
| 8,348,071 | B1 | * | 1/2013 | Janlert | 211/175 |
| 8,397,443 | B2 | * | 3/2013 | Blom et al. | 52/126.7 |
| 8,640,420 | B1 | * | 2/2014 | Halley | 52/653.1 |
| 2001/0023563 | A1 | * | 9/2001 | Phillips | 52/292 |
| 2002/0023888 | A1 | | 2/2002 | Wynne et al. | |
| 2002/0066237 | A1 | * | 6/2002 | Stevenson et al. | 52/36.1 |
| 2004/0140412 | A1 | * | 7/2004 | Hendzel et al. | 248/440 |
| 2004/0182025 | A1 | * | 9/2004 | Moutsokapas et al. | 52/299 |
| 2006/0016078 | A1 | * | 1/2006 | Bladow et al. | 29/897.312 |
| 2007/0145222 | A1 | | 6/2007 | Rausch | |
| 2007/0246434 | A1 | | 10/2007 | Adams et al. | 211/8 |
| 2008/0163573 | A1 | * | 7/2008 | Wendelburg et al. | 52/262 |
| 2009/0095856 | A1 | * | 4/2009 | Nakatani | 248/177.1 |
| 2010/0006526 | A1 | | 1/2010 | Konstant | |
| 2010/0132286 | A1 | * | 6/2010 | Hovey, Jr. | 52/299 |
| 2010/0223877 | A1 | * | 9/2010 | O'Hara et al. | 52/636 |
| 2011/0023387 | A1 | * | 2/2011 | Sweeney et al. | 52/167.4 |
| 2011/0072631 | A1 | * | 3/2011 | Hartelius et al. | 29/428 |
| 2012/0153657 | A1 | * | 6/2012 | Kapoor | 296/19 |
| 2013/0221303 | A1 | * | 8/2013 | Ash | 256/65.12 |
| 2013/0306808 | A1 | * | 11/2013 | Huang | 248/163.1 |
| 2014/0048678 | A1 | * | 2/2014 | Chen et al. | 248/678 |
| 2014/0075980 | A1 | * | 3/2014 | Villar | 62/297 |

OTHER PUBLICATIONS

Diamond Storage Concepts LLC, HyLoft Storage Unit #00626 Installation Instructions (date unknown).

Diamond Storage Concepts LLC, HyLoft Storage Unit #80842-10 Installation Instructions (2006).

* cited by examiner

SUPPORT APPARATUS

CROSS REFERENCE TO RELATED APPLICATIONS

This application is a continuation-in-part of U.S. application Ser. No. 13/866,754 filed Apr. 19, 2013, now pending, which in turn, is a continuation-in-part of U.S. application Ser. No. 13/274,763 filed Oct. 17, 2011, now U.S. Pat. No. 8,827,232, which in turn, is a continuation-in-part of U.S. application Ser. No. 13/006,316 filed Jan. 13, 2011, now U.S. Pat. No. 8,701,261. Each of the aforementioned applications is incorporated herein by reference in its entirety.

BACKGROUND

The present disclosure relates to improved systems and methods for hanging or standing shelving units for a number of applications including without limitation support units for building heating, ventilation, and air conditioning ("HVAC") systems and components, as well as suspended shelving units for holding, for example, children's games and toys, closet organizers with hangers and shelves, adjustable pipe hangers with preset means to ensure proper drainage pitch, for storage space in a garage or workshop, storage shelves over a garage door, and as a hanging unit for audio/visual equipment.

DESCRIPTION OF RELATED ART

Interior spaces of homes and other buildings are typically provided with areas for storage and storage solutions which are not adequate for the storage needed in the home or building. Hangers for mounting HVAC units, hanging pipes, and storing other items in a building are known in the prior art. More specifically, by way of example, U.S. PreGrant Publication No. 2007/0145222 to Rausch discloses a method and device for a hanging apparatus that is used to support ductwork, pipes, wiring, conduit and the like from support beams such as I-Joists.

U.S. Pat. No. 7,596,962 to Karamanos discloses, prior to installation into a HVAC system a fully-functional zone-control unit which also includes a pair of caps which seal the ends of the piping assemblies, and a pressure gauge for sensing pressurization of the piping assemblies and coil which the caps seal. A pressure gauge permits testing to insure that the piping assemblies and coil are leak free.

U.S. Pat. No. 7,261,256 to Pattie, et al. discloses a variable-duct support assembly for mounting a duct. The variable-duct support assembly includes rails having a groove which has a pair of support brackets for supporting ducts. The support brackets are coupled to one or more flexible bands for clamping the duct between the support brackets and the flexible bands.

U.S. Pat. No. 7,083,151 to Rapp discloses a laterally-reinforced duct saddle for hanging a length of horizontal flexible duct from a supporting structure. The duct saddle includes a generally flat, elongated blank adapted for bending around and receiving a portion of the flexible duct.

U.S. Pat. No. 6,866,579 to Pilger discloses a boot hanger mounting bracket assembly formed of a sturdy yet bendable material so that it can be configured and adjusted on-site. Once configured, the boot hanger mounting bracket assembly is secured to the building structure by securing a pair of boot hanger arms to the ceiling joists, wall studs or other support structure to provide a positive inexpensive way to mount the duct components.

U.S. Pat. No. 6,719,247 to Botting discloses a hanger for seating a flexible duct. The hanger has one end that can be attached to a support structure, such as a beam or joist, and a second end with a cradle for receiving a duct that can be freely seated in the cradle.

U.S. Pat. No. 5,741,030 to Moore, et al. discloses an air duct starting collar having integral clips used for installation in a planar surface of an air duct. A flange of the device permits variance in hole size, and roughness of the hole's edge.

SUMMARY

In one aspect, an apparatus is provided for a hanging shelving unit having at least one arm adapted to be attached at its top end to a steel beam, wood rafter, wood joist, wood beam, or ceiling, a bar adapted to be slidably coupled to the arm having a first horizontally extending arm located at the bottom of the bar to form a J bar, clearance openings located in the arm and in the J bar for receiving fasteners for attaching the arm to the J bar to raise or lower the first horizontally extending arm to provide for storage at different heights, a first extension member removably coupled to the first vertically displaced horizontally extending arm, and wherein the first extension member has a length that provides for storage space of different widths and is adapted to be removably attached to a first vertically displaced horizontally extending arm on an opposing J bar.

In another aspect, an apparatus is provided for a standing shelving unit having at least one leg adapted to be attached at its bottom end to a steel beam, wood rafter, wood joist, or wood beam, a bar adapted to be slidably coupled to the leg having a first horizontally extending arm located at the top of the bar to form a L bar, clearance openings located in the leg and in the L bar for receiving fasteners for attaching the leg to the L bar to raise or lower the first horizontally extending arm to provide for storage at different heights, a first extension member removably coupled to the first vertically displaced horizontally extending arm, and wherein the first extension member has a length that provides for storage space of different widths and is adapted to be removably attached to a first vertically displaced horizontally extending arm on an opposing L bar.

In yet another aspect, a method for hanging the adjustable shelving unit is provided.

In a further aspect, a method for securing the standing adjustable shelving unit is provided.

One advantage of the present development resides in the versatility of the shelving unit which provides for a variety of widths and heights to provide a hanging or standing shelving unit that can be used for a number of applications including building heating, ventilation, and air conditioning ("HVAC") systems, a shelving unit for holding children's games and toys, as a closet organizer with hangers and shelves, for storage space in a garage or workshop, storage shelves over a garage door, and as an audio/visual equipment hanging unit.

Another advantage of the present development is the ability to easily adjust the height of the hanging or standing unit.

Still another advantage of the present development is the ability to easily add additional shelves to the unit and to adjust the height to accommodate what needs to be stored.

Other benefits and advantages of the present disclosure will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 3 is a front perspective view of a second embodiment support unit, having front and rear, left and right hanging arms, where the hanging arms consist of a means of attachment at their upper ends to a support member or the ceiling, and at their lower ends to "J" shaped bars having a horizontal extension for holding various items, including HVAC units, clothes, toys, games, television and audio visual equipment, and the like.

FIG. 6 is a side view of a third embodiment support unit, having front and rear, left and right hanging arms, where the hanging arms consist of a means of attachment at their upper ends to a support member or the ceiling, and at their lower ends to "J" shaped bars having a horizontal extension for holding various items, and a plurality of the shelves and hanging bars for holding various items, including HVAC units, clothes, toys, games, and the like.

FIG. 8 is a side view of a fifth embodiment support unit, having front and rear, left and right hanging arms, where the hanging arms consist of a means of attachment at their upper ends to a support member, ceiling, or closet system, at their lower ends to "J" shaped bars having a horizontal extension and adjustable shelves for holding various items such as clothes, toys, games, and the like.

FIG. 9 is a front perspective view of a sixth embodiment support unit for hanging over a garage door, having front and rear, left and right hanging arms, where the hanging arms consist of a means of attachment at their upper ends to a support member or ceiling, at their lower ends to "J" shaped bars having a horizontal extension and a plurality of supports for holding various items such as tools, yard equipment, and the like.

FIG. 16 is a front perspective view of an alternative embodiment support unit, having left and right hanging arms, where the hanging arms consist of a means of attachment at their upper ends to a support member or the ceiling, and at their lower ends to "U" shaped bar having an attachment mechanism for holding various items, including HVAC units, television and audio visual equipment, hanging storage units, pot racks, and the like.

DETAILED DESCRIPTION OF THE PREFERRED EMBODIMENTS

Figure 1:
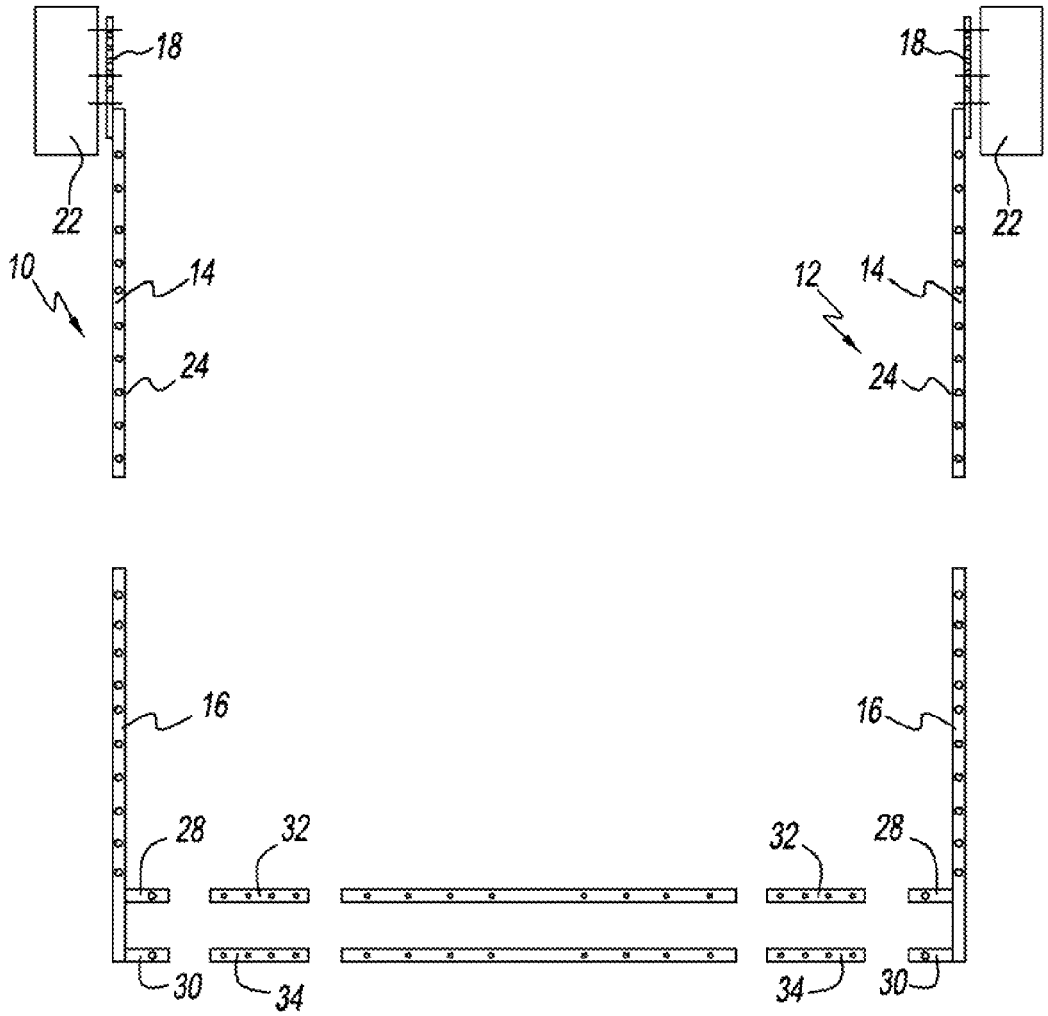
FIG. 1 is a side view of the rear left and rear right hanging arms of the support unit, the front left and front right hanging arms not being shown, where the hanging arms consist of upper paddle arms attached at their upper ends to separate support members and at their lower ends to a J shaped bar having an upper horizontal extension for receiving a telescoping connecting member for supporting an HVAC unit and a telescoping lower horizontal extension for receiving a telescoping extension for supporting an emergency drain pan.
Figure 2:
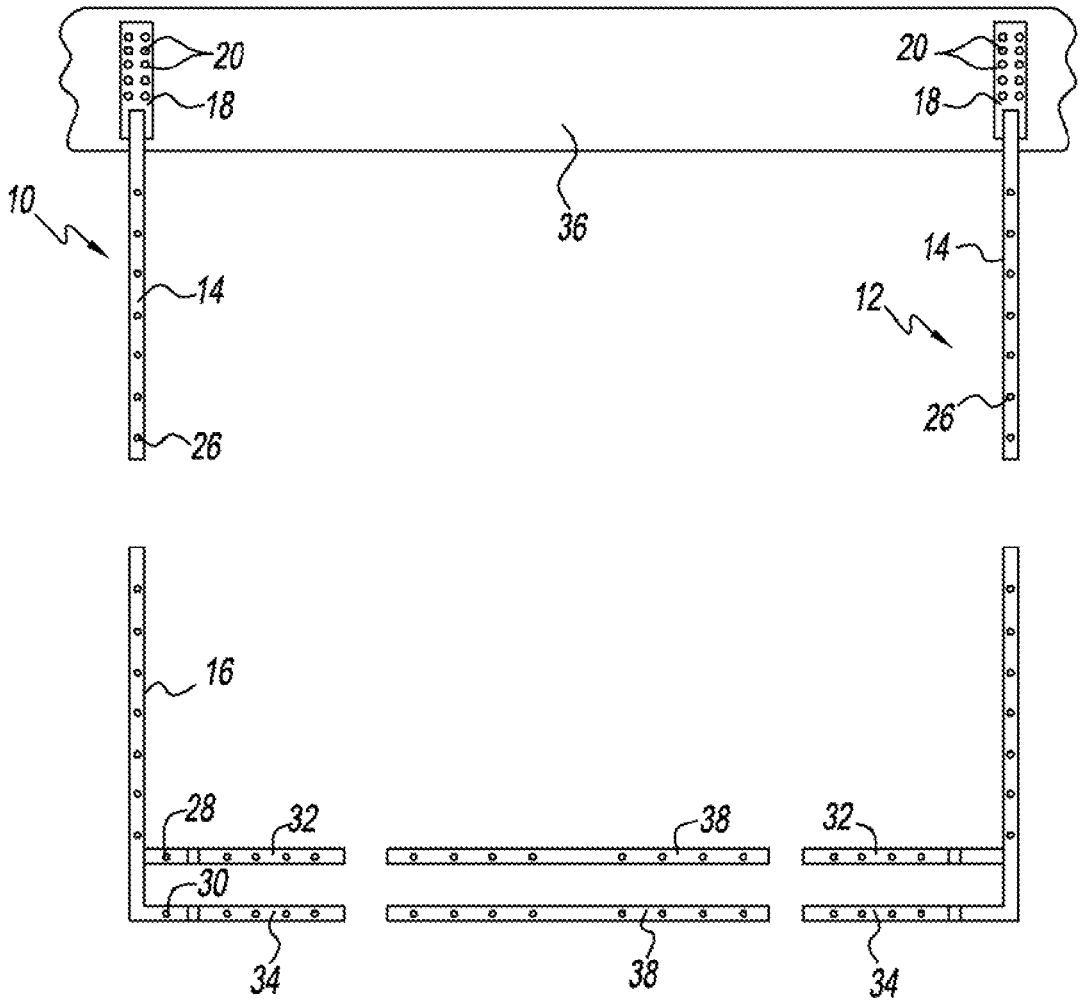
FIG. 2 is a side view of the rear left and rear right hanging arms of the support unit, the front left and front right hanging arms not being shown, where the hanging arms consist of upper paddle arms which are turned ninety degrees and are attached at their upper ends to a common support member, and at their lower ends to "J" shaped bars having an upper horizontal extension for receiving an AC unit and a lower horizontal extension for receiving an emergency drain pan.
Figure 3:
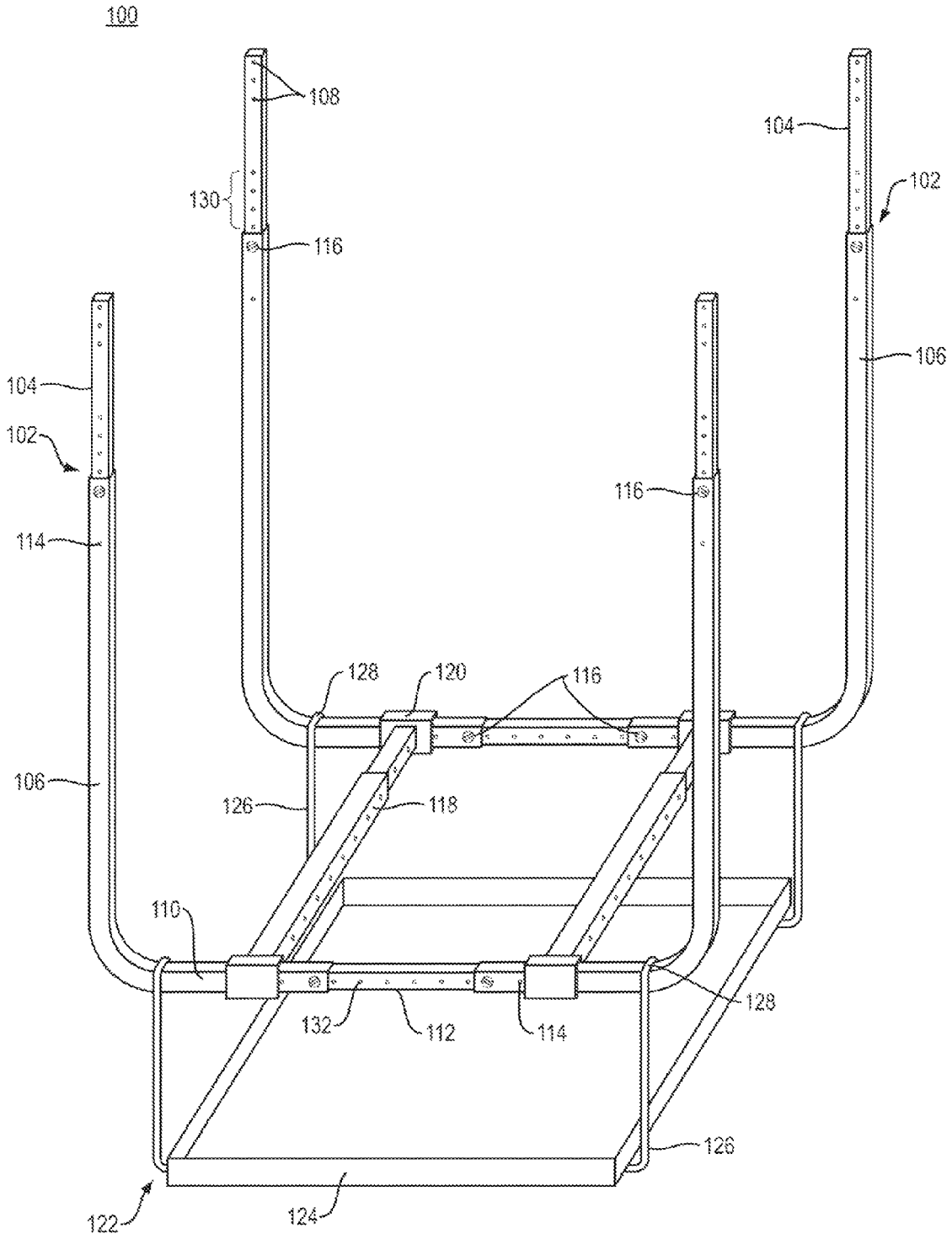
Figure 4B:
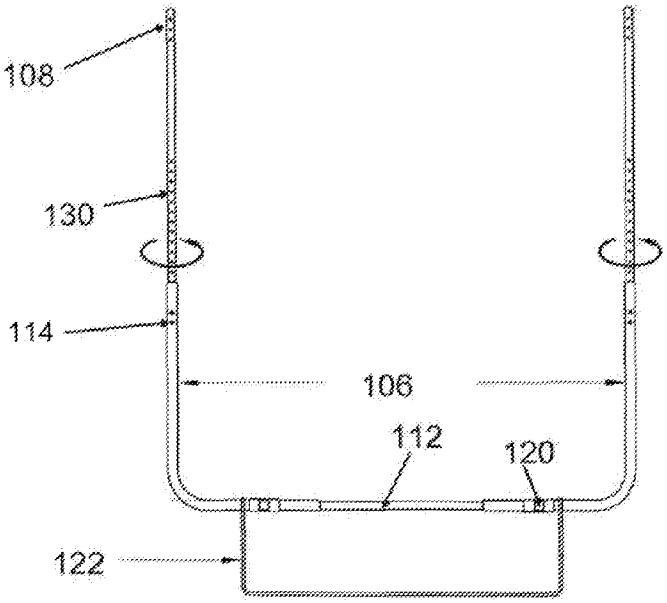
FIG. 4B is a fully expanded side view of the embodiment of FIG. 4A, having rear left and rear right hanging arms of the support unit, the front left and front right hanging arms not being shown, where the hanging arms consist of an attachment section and are attached at their upper ends to a common support member, and at their lower ends to "J" shaped bars having a horizontal extension for receiving an AC unit and a drain pan support member for receiving an emergency drain pan.
Figure 4D:
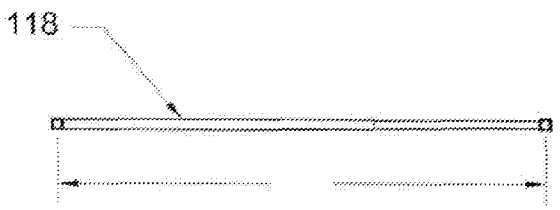
FIG. 4D is a fully expanded side view of the support member appearing in FIGS. 4A-4C.
Figure 4A:
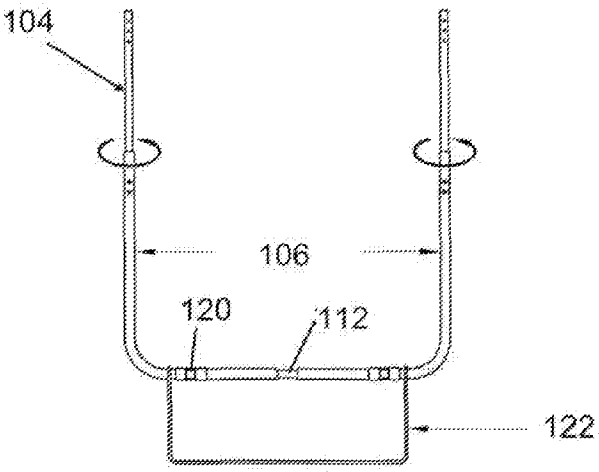
FIG. 4A is a fully retracted side view of the embodiment appearing in FIG. 3, having rear left and rear right hanging arms of the support unit, the front left and front right hanging arms not being shown, where the hanging arms consist of an attachment section and are attached at their upper ends to a common support member, and at their lower ends to "J" shaped bars having a horizontal extension for receiving an AC unit and a drain pan support member for receiving an emergency drain pan.
Figure 4C:
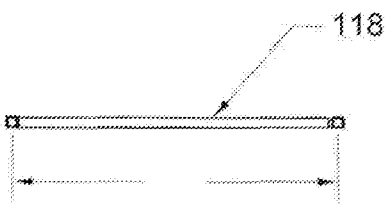
FIG. 4C is a fully retracted side view of the support member appearing in FIGS. 4A and 4B.
Figure 5:
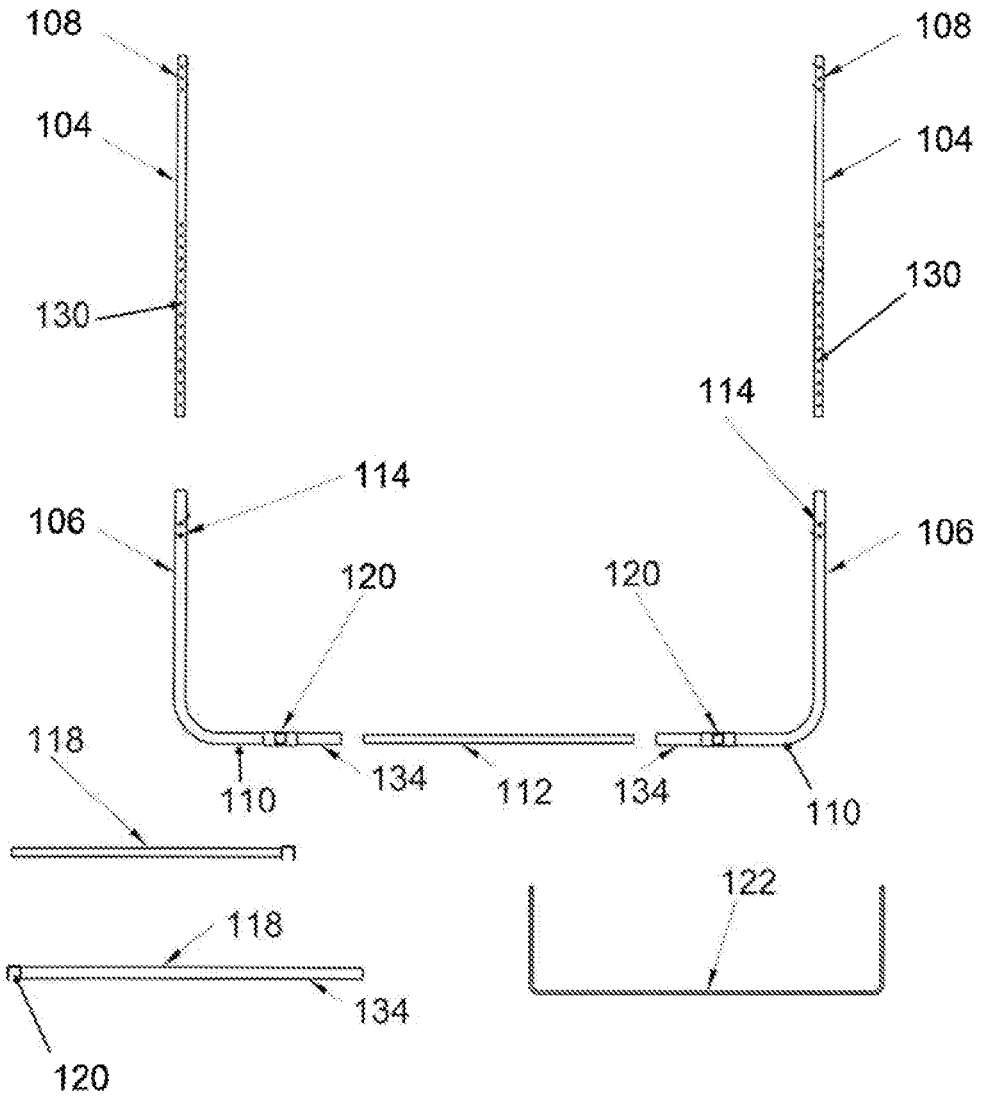
FIG. 5 is an exploded side view of the support unit embodiment appearing in FIGS. 3, 4A and 4B.

Referring to FIGS. 1 and 2 the support unit embodiment disclosed is composed of four upper arms adapted to be connected to four "J" shaped bars where each J shaped bar has an upper horizontal extension for receiving an HVAC unit and a lower horizontal extension for receiving an emergency drain pan. The upper arms and the J bars are composed of square metal tubing precut to size and fabricated to shape. The upper arms and the J bars have drilled or punched openings located on centers which are between one and two inches for adjustability. The upper arms are sized to telescope into and out of the J bars to provide for different height adjustments.

Each J bar has two horizontal arms where the upper horizontal arm is used to provide support for an HVAC unit and the lower horizontal arm is used to provide support for an emergency drain pan. Each horizontal arm is sized to telescope into a connecting sleeve and the horizontal arms and connection sleeves have openings for receiving ringed clevis pins or nuts and bolts to lock the two together. Extension members of various lengths are available which telescope into the coupling sleeves for adjusting the width between the left and right J bars to the width of the HVAC unit which is to be supported by the air handler support unit. The extension members and the coupling sleeves each have openings which are spaced apart by between one and two inches, more or less for receiving ringed clevis pins or nuts and bolts to lock the two together for different dimension applications.

The paddle arms each have at their upper ends a flat plate which is adapted to be located next to a wood support member and has openings which are provided to receive bolts or screws which are used to attach the paddle arm to a wood support member such as a wood rafter, joist or beam.

In another embodiment the flat plate at the upper ends of the paddle arms is adapted to receive at least one C clamp which is used to attach the paddle arms to steel beams.

The air handler support unit disclosed telescopes both horizontally and vertically to accommodate units having various heights and widths. The spacing between the front and rear paddle arms is varied to accommodate the length of the HVAC unit. The support unit bottom shelf may be outfitted with two "H" hangers to receive the telescoping emergency drain pan horizontal arm, which can be relocated to the upper shelf to help in removing internal parts of each unit. The entire support unit disclosed is adjustable to receive HVAC units of different heights, widths and lengths.

Referring to FIG. 1, there is disclosed a side view of the rear left hanging arm 10 and rear right hanging arm 12 of the air handler support unit, the front left and front right hanging arms not shown, where each hanging arm consists of an upper paddle arm 14 and a "J" bar 16 at its lower end. In this embodiment each of the hanging arms, the left and right rear hanging arms and the left and right front hanging arms are similar in all aspects and, therefore, the detailed description of the rear left hanging arm which follows applies to each of the other hanging arms.

Upper paddle arm 14 is a square tube composed of steel and having a length of about twenty four inches, more or less. The top of the paddle arm 14 is welded to a flat plate 18 having a length of about eight inches, a width of about three inches and a thickness of about one-eighth of an inch, more or less. The flat plate 18 has two columns of openings 20, (see FIG. 2), which are sized for receiving screws or bolts for attaching the paddle arm 14 to a wood support member such as a wood rafter, joist or beam. In the embodiment of FIG. 1 the upper paddle arms are attached to separate wood rafters, joists or rafters.

The paddle arm 14 has a first plurality of openings 24 located at spaced apart intervals (e.g., on two inch centers) which are parallel to the width of the flat plate, and a second plurality of openings 26, (see FIG. 2), located at spaced apart intervals (e.g., on two inch centers) which are transverse to the width of the flat plate and are located between the first plurality of openings 24. The paddle arm 14 which is a square tube composed of steel with an outside dimension of between one-half of an inch and one inch, more or less, telescopes into the J bar 16. The J bar 16 is a square tube composed of steel with an inside dimension which makes a sliding fit with the outside dimension of paddle arm 14 and has a length of about twenty two and one-half inches, more or less. Located at the bottom of the J bar 16 are two horizontally extending arms 28, 30 which are welded to the J bar 16 and are vertically displaced from each other by a distance of about five inches, more or less. Each arm 28, 30 is a square tube with a width that is similar to the width of the tube 14, is made of steel, has a length of about two inches, more or less, and telescopes into connecting sleeves 32, 34. The J bar 16 and horizontal arms 28, 30 have clearance openings for receiving ringed Clevis pins or nuts and bolts for attaching the J bar 16 to the paddle arm 14 and the arms 28, 30 to connecting sleeves 32, 34. Connecting sleeves 32, 34 each have a length of about fourteen inches, more or less.

Referring to FIG. 2, there is disclosed a side view of the rear left and rear right hanging arms of the support unit, the front left and front right hanging arms not shown, where the support unit of FIG. 2 differs from FIG. 1 only in that the upper paddle arms of the hanging arms are turned ninety degrees and are attached at their upper ends to a common support member rather than to separate support members such as a wood rafter, joist or beam 36 with bolts or screws.

Each J bar telescopes over and is adjustably attached to a paddle arm which allows for different height adjustments from twenty six inches to forty inches in two inch increments. Connecting sleeves 32, 34 on opposing horizontally extending arms 32, 34 of the J bars telescope around horizontal extension members 38 for different width adjustments of between twenty eight inches and forty inches in two inch increments.

Referring now to FIGS. 3, 4A-4B, and 5 there appears a second embodiment of the support unit 100 having four hanging arms 102 and where each hanging arm 102 consists of an upper arm 104 and a "J" bar 106 at its lower end. The upper arms 104 are a square tube composed of steel or another metal/metal alloy and the top of the upper arms 104 having a first plurality of openings 108 on the front and rear of upper arms 104, three openings in the preferred embodiment, which are sized for receiving screws, bolts, or the like for attaching the upper arms 104 to hang the support unit 100 to a steel beam, wood rafter, wood joist, wood beam, ceiling, or the like. If the first plurality of openings 108 does not align with the desired support member the upper arms 104 may be rotated ninety degrees to align with the desired support member for attachment using a screw, bolt, or the like. Alternatively, the arms 104 may have a plurality of openings 109 on the left and right of the upper arms 104, three openings in the preferred embodiment, offset from the first plurality of openings 108 which are sized for receiving screws, bolts, or the like for attaching the upper arms 104 to hang the support unit 100 to a steel beam, wood rafter, wood joist, wood beam, ceiling, or the like.

In the present embodiment, a second plurality of openings 130 of the upper arms 104 are located at spaced apart intervals (e.g., on two inch centers) on the front and rear of the square tube, and a third plurality of openings 136, are located at spaced apart intervals (e.g., on two inch centers) on the left and right side of the square tube offset from the second plurality of openings 130. The second and third plurality of openings 130 and 136, respectively, are located at a desired interval for the intended use of the support unit 100. The upper arms 104 telescope into the J bars 106. The J bars 106 may be square tubes composed, for example, of steel or other metal or metal alloy with an inside dimension which makes a sliding fit with the outside dimension of the upper arms 104. Located at the bottom of each J bar 106 is a horizontally extending arm 110 which may be integral with the vertical portion of the J bar bent to form the horizontally extending portion 110 of the J bar 106. Alternatively, the horizontal arms 110 may be separately formed and attached, e.g., by welding the horizontally extending arms 110 to the bottom of the upper portion of the J bars 106. The arms 110 may be square tubes with the same width as the width of the vertically extending portion of the J bars 106.

The extension members 112 are telescopically received within the arms 110. The J bars 106 and horizontal arms 110 have one or more clearance openings 114 for receiving fasteners 116 for securing the J bars and the telescopically received arms 104 and extension members 112 in fixed position. The fasteners 116 may be, for example, pins, Clevis pins, thumb screws, nuts and bolts, or the like for attaching the J bars 106 to the arms 104 and the horizontally extending arms 110 to the extension members 112. Depending on the means used to secure the extension members 112 inside of the horizontally extending arms 110, the extension members 112 may include a plurality of openings 132 evenly spaced apart along the member 112. In the preferred exemplary embodiment the extension members 112 enable the support unit 100 to expand from approximately 32 inches wide to approximately 48 inches wide although other dimensions are contemplated. The extension members 112 are secured inside of the horizontally extending arms 110 via fasteners 116 which pass through the clearance openings 114 and into one of the plurality of openings 132 to secure the unit 100 at the desired width.

One or more support members 118 may optionally be attached to the horizontal arms 110. The support members 118 are attached to the arms 110 using coupling sleeves or hooks 120. The coupling hook 120 at a first end of the support member 118 attaches to one horizontally extending arm 110 and the coupling hook 120 at a second end of the support member 118 attaches to a parallel horizontal arm 110. The support members 118 provide additional support for items that are being stored on the support unit 100. The support members 118 may be square tubes composed, for example, of steel or other metal or metal alloy with a dimension to hold the weight of the item selected for supporting. The coupling hooks 120 may be welded to the ends of the support members 118 and may be made of a sheet of steel or other metal or metal alloy which is bent to create three sides which slip over the square tubes of the horizontal arms 110. The inside dimension of the coupling hooks 120 makes a sliding fit with the outside dimension of the horizontal arms 110.

In an alternative embodiment, the support members 118 may include two arms (not shown) where the first arms (not shown) telescope into the second arms (not shown) to increase and decrease the width between the horizontal arms 110 of the support unit 100. The first and second arms (not shown) each having a coupling hook 120 attached at the outside end for securing to the horizontal arms 110. The first and second arms may be square tubes composed of a metal or metal alloy (e.g., steel) with the inside dimension of the first arm making a sliding fit with the outside dimension of the second arm at their inside ends.

As best seen in FIGS. 3, 4A-4D and 5 an optional pan support 122 having a lower pan 124 and "J" bars 126. The "J" bars 126 have hooks 128 on the upper end for securing the pan support 122 to the arms 110 of the support unit 100 and are secured at the lower end to the pan 124. In the exemplary embodiment, the pan 124 may be used to catch water from an HVAC unit that is not working properly.

Figure 6:
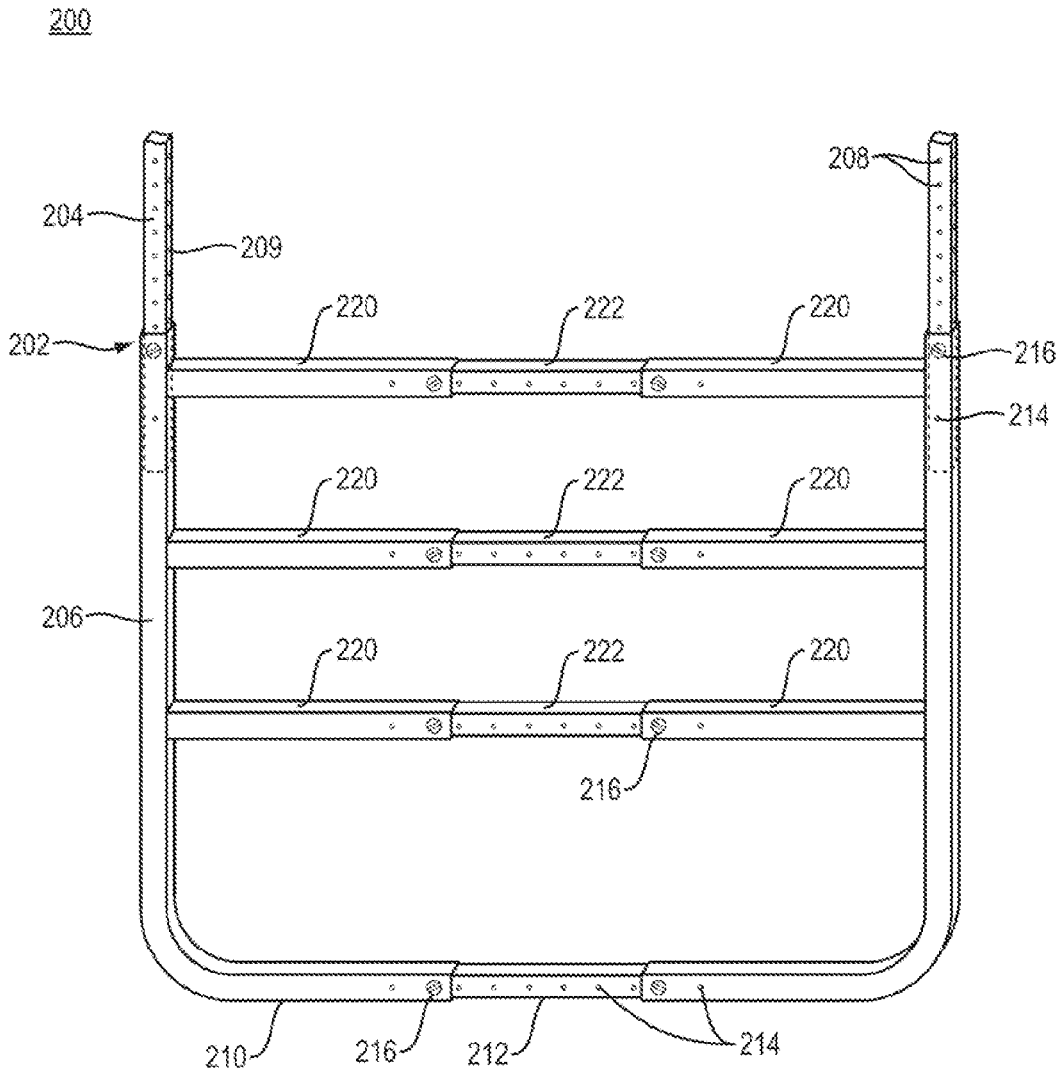

Referring now to FIG. 6, there appears a further embodiment support unit 200 which may be used as a suspended shelving unit. The unit 200 may advantageously be used for holding children's games and toys, however, myriad of other uses are contemplated. The support unit 200 may be hung, for example, from the ceiling of a child's bedroom or playroom to provide additional storage for toys, games, stuffed animals, and the like. The support unit 200 includes four hanging arms 202, where each hanging arm 202 consists of an upper arm 204 and a "J" bar 206 telescopically receiving the upper arm 204 at its lower end. The upper arms 204 may be a square tube and may be composed of steel or another metal or metal alloy. The top of the upper arm 204 having a first plurality of openings 208, which are sized for receiving screws, bolts, or the like for attaching the upper arms 204 to hang the support unit 200 to a steel beam, wood rafter, wood joist, wood beam, ceiling, or the like.

In the present embodiment, the first plurality of openings 208 of the upper arms 204 are located at spaced apart intervals (e.g., on two inch centers) on the front and rear of the square tube, and a second plurality of openings 209, are located at spaced apart intervals (e.g., on two inch centers) on the left and right side of the square tube offset from the first plurality of openings 208. The first and second plurality of openings 208 and 209, respectively, are located at a desired interval for the intended use of the support unit 200. The upper arms 204 telescope into the J bar 206 to raise and lower the height of the support unit 200. The J bar 206 may be a square tube composed of a metal or metal alloy (e.g., steel) with an inside dimension which makes a sliding fit with the outside dimension of the upper arms 204.

Located at the bottom of the J bar 206 is one horizontally extending arm 210 which may be integral with the vertical portion of the J bar and bent to form the horizontally extending portion 210 of the J bar 206. Alternatively, the horizontal arms 210 may be separately formed and attached, e.g., by welding the horizontally extending arms 210 to the bottom of the upper portion of the J bars 206. The arms 210 may be square tubes with the same width as the width of the vertically extending portion of the J bars 206. One or more additional horizontally extending arms 220 are located on the vertical portion of the J bar 206 above the horizontally extending arm 210 and are welded to the J bar 206. Each arm 220 is a square tube with a width the same as the width of the horizontally extending arm 210. The arms 220 may alternately be attached to the J bar 206 using coupling sleeves, the coupling sleeve may slide over the vertical portion of the J bar 206 and may be secured to the J bar 206 via a fastener. The extension member 212 telescopes into the arm 210 and each of the extension members 222 telescope into the corresponding and aligned arms 220. The J bar 206 and horizontal arms 210 and 220 have clearance openings 214 for receiving fasteners 216 for securing the J bars 206 to the arms 204 and the telescopically received extension members 212 and 222 to the arms 210 and 220, respectively, in a fixed position. The fasteners 216 may be, for example, pins, Clevis pins, thumb screws, nuts and bolts, or the like for attaching the J bars 206 to the arms 204 and the extension members 212 and 222 to the arms 210 and 220.

Figure 7:
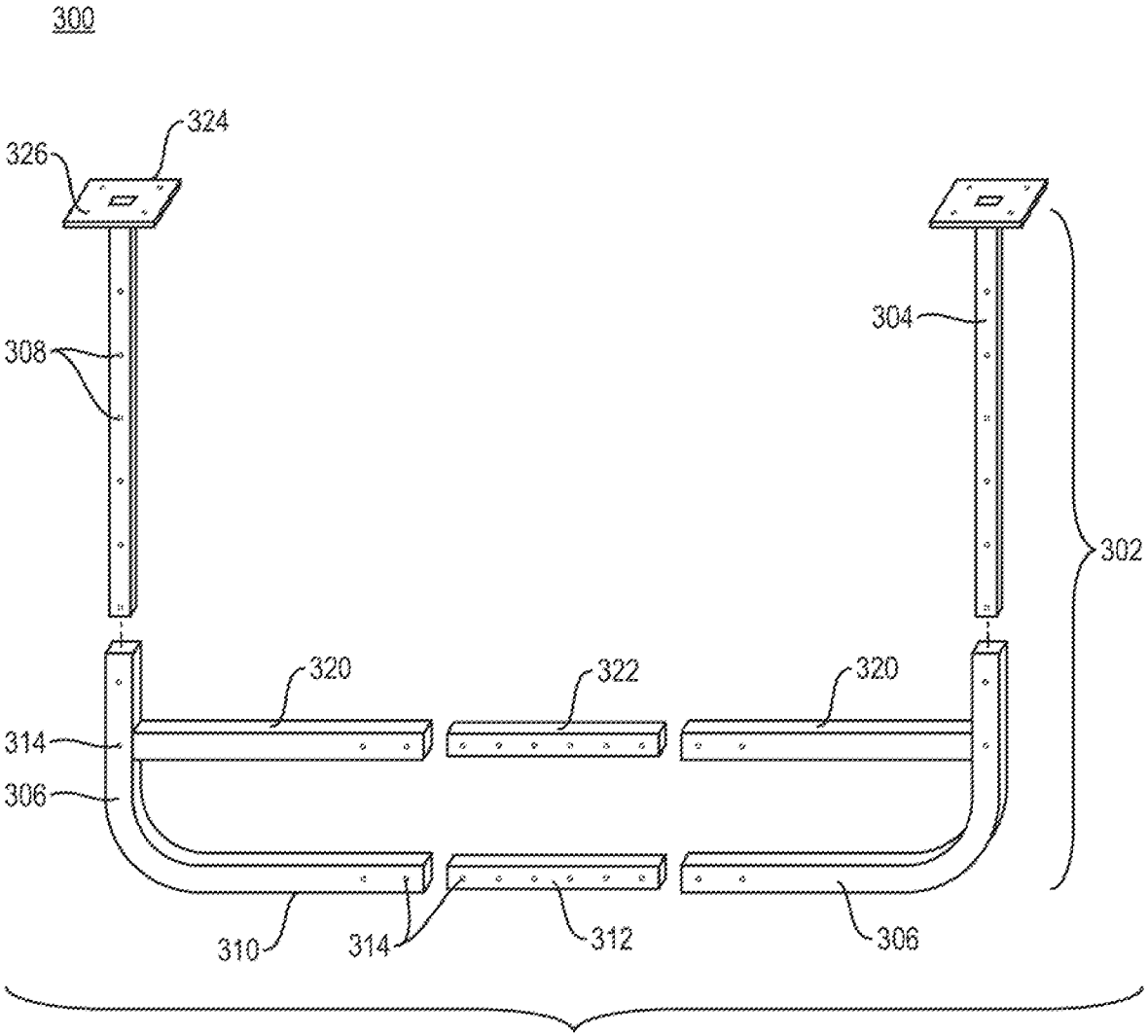
FIG. 7 is a side view of a forth embodiment support unit, having front and rear, left and right hanging arms, where the hanging arms consist of a means of attachment at their upper ends to a support member or the ceiling, at their lower ends to "J" shaped bars having a horizontal extension for holding various items such as DVD players, blue ray players, cable boxes, and the like, and an upper shelf having a horizontal extension for holding a television unit.

Referring now to FIG. 7, there appears yet another embodiment support unit 300 which may advantageously be used as a hanging support unit for audio and/or video equipment, such as televisions and related audio and visual equipment. The support unit 300 includes four hanging arms 302, where each hanging arm 302 consists of an upper arm 304 and a "J" bar 306 at its lower end. The upper arms 304 are square tubes composed of metal or metal alloy (e.g., steel). The top of the upper arm 304 has a first plurality of openings 308, which are sized for receiving screws, bolts, or the like for attaching the upper arms 304 to hang the support unit to a steel beam, wood rafter, wood joist, wood beam, ceiling, or the like. For attachment to a finished ceiling, an attachment plate 324 may be secured to the top of each upper arm 304. The attachment plate 324 has a plurality of openings 326, four openings in the preferred exemplary embodiment, which are sized for receiving screws, bolts, or the like for attaching the upper arms 304 to a joist in the ceiling or anchoring the upper arms 304 into the drywall.

The upper arms 304 and horizontally extending arms 310 are of the type described above with reference to FIGS. 3-6. The upper arms 304 are telescopically received into the J bars 306. The J bars 306 are of the type described above with reference to FIGS. 3-6. Located at the bottom of the J bar 306 are two horizontally extending arms 310 and 320. The arms 310 may be integral with the vertical portion of the J bar and bent to form the horizontally extending portions 310 of the J bar 306, while the horizontal arms 320 may be separately formed and attached, e.g., by welding the horizontally extending arms 320 to the vertical portion of the J bars 306 at a desired separation above the horizontally extending arms 310. Alternatively, the horizontal arms 310 may be separately formed and attached, e.g., by welding the horizontally extending arms 310 to the bottom of the vertical portion of the J bars 306. The extension members 312 and 322 are telescopically received within the arms 310 and 320, respectively, to obtain the desired separation between opposing J bars 306. The extension members 312 and 322 are of the type described above with reference to FIGS. 3-6.

The shelf created by arms 310 and extension members 312 may be used to hold audio and visual equipment, such as cable boxes, DVD players, game consoles, and the like. The shelf created by arms 320 and extension members 322 may be used to suspend a television from the ceiling at a desired height rather than mounting it onto a wall or supported on a stand. Although the illustrated embodiment shows two horizontal shelves, it will be recognized that additional supports may be inserted to provide additional support for the television and audio and visual components.

Figure 8:
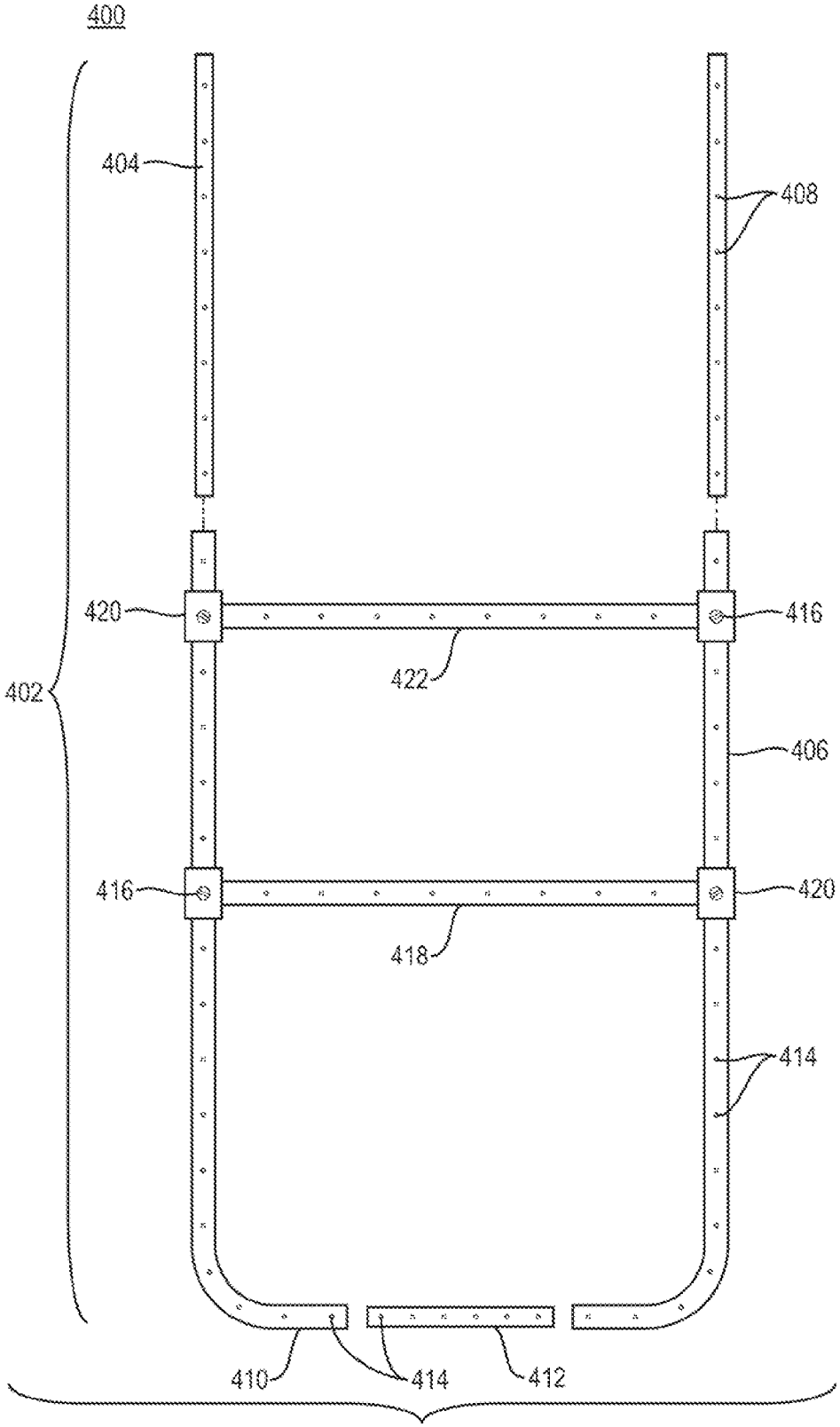

Referring now to FIG. 8, there appears another embodiment support unit 400 which may advantageously be used as a closet organizer with hangers and shelves. The support unit 400 includes four hanging arms 402 where each hanging arm 402 consists of an upper arm 404 and a "J" bar 406 at its lower end. The upper arms 404 are a square tube composed of a metal or metal alloy, such as steel. The top of the upper arm 404 having a first plurality of openings 408, which are sized for receiving screws, bolts, or the like for attaching the upper arms 404 to hang the support unit 400 to a steel beam, wood rafter, wood joist, wood beam, ceiling, or the like. For attachment to a finished ceiling, an attachment plate not shown may be secured to the top of each upper arm 404. The attachment plates may have a plurality of openings not shown, which are sized for receiving screws, bolts, or the like for attaching the upper arms 404 to a joist in the ceiling or anchoring the upper arms 404 into the ceiling drywall.

The upper arms 404 and horizontally extending arms 410 are of the type described above with reference to FIGS. 3-7. The upper arms 404 telescope into the J bar 406. The J bar 406 is of the type described above with reference to FIGS. 3-7. Located at the bottom of the J bar 406 are a plurality of horizontally extending arms, there are three horizontally extending arms in the preferred embodiment 410, 418, and 422. Although the illustrated embodiment shows three horizontal arms, it will be recognized that arms may be removed or additional arms may be added to provide more or less shelves for the shelving unit 400. The horizontally extending arm 410 may be integral with the vertical portion of the J bar and bent to form the horizontally extending portion 410 of the J bar 406, while the arms 418 and 422 may be secured onto the J bar 406 at a desired separation above the arm 410 using coupling sleeves 420. The coupling sleeves 420 may be secured to the J bar 406 using fasteners 416, e.g., pins, Clevis pins, nuts and bolts, or the like. Alternatively, the arms 410, 418 and 422 may be separately formed and attached, e.g. via welding, at fixed positions on the J bars 406.

The extension member 412 telescopes into arm 410 and is slidably adjustable to obtain the desired separation between opposing J bars 406. The extension member 412 is of the type described above with reference to FIGS. 3-7. The arms 418 and 422 may come in a variety of sizes to correspond to the sizes of the arms 410 and extension member 412. In one alternative embodiment, the arms 418 and 422 may be segmented, including an extension member in the center of the segmented arms 418 and 422 which telescopes into the arms 418 and 422 to allow for adjustment of the arms 418 and 422 in the same manner as arm 410. In another alternative embodiment, the arms 418 and 422 may be comprised of two telescopic segments.

The shelves created by arm 410 and extension member 412, and arms 418, and 422 may advantageously be used as closet shelves for clothes, shoes, sheets, towels, and any other items stored in a closet and may include transversely-extending rods for clothing and other items on clothes hangers. Additional arms may be added to provide additional shelves and rods for alternative closet storages shelving arrangements.

Figure 9:
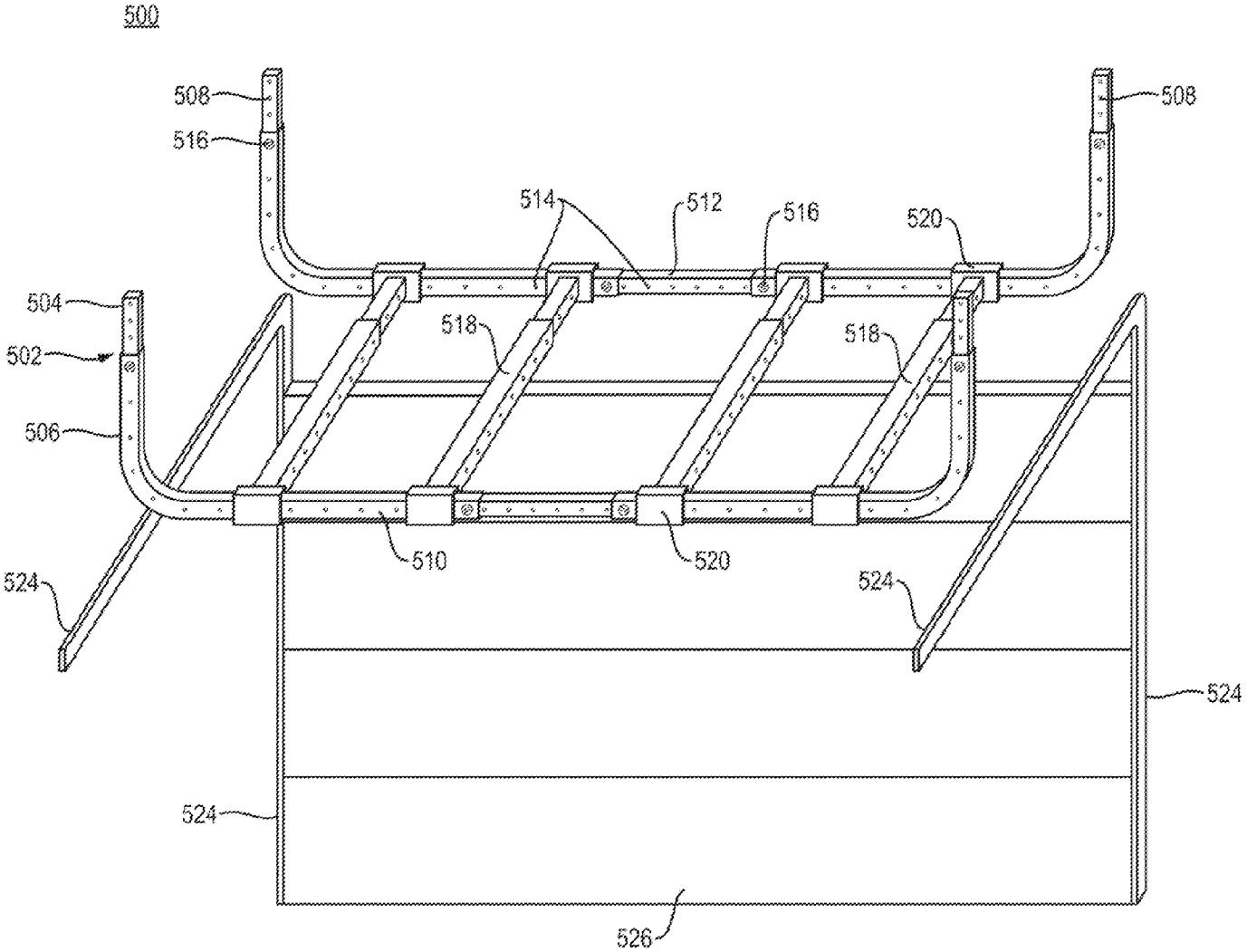
Figure 10A:
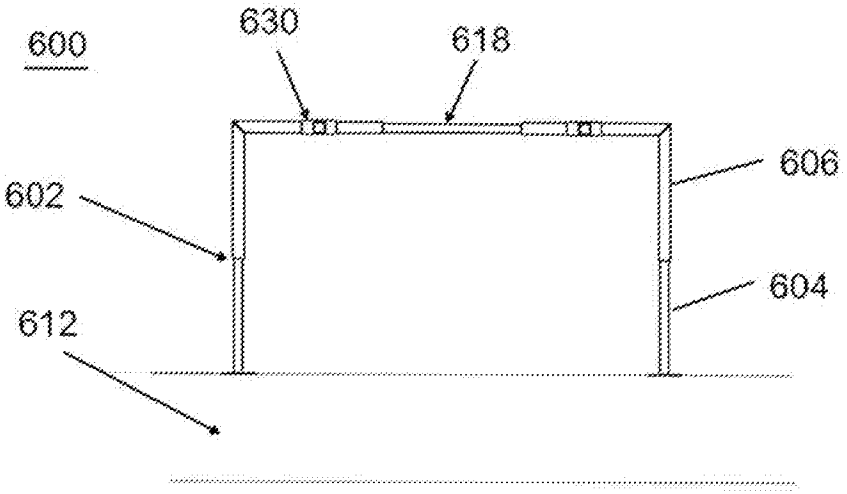
FIG. 10A is a fully expanded front view of the support unit, having front right and front left standing legs, the rear right and rear left standing legs not being shown, where the standing legs consist of an attachment section and are attached at their lower ends to a common support member, and at their upper ends to bars at right angles having a horizontal extension.
Figure 10B:
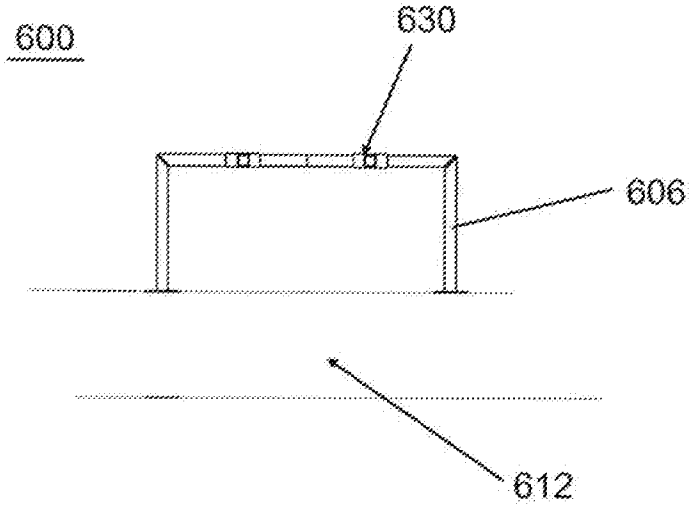
FIG. 10B is a fully retracted front view of the support unit embodiment appearing in FIG. 10A.
Figure 10C:
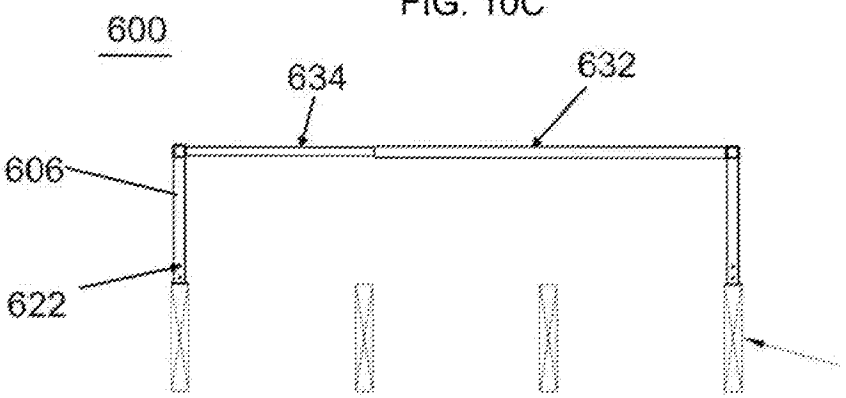
FIG. 10C is a partially expanded side view of the support unit embodiment of FIGS. 10A and 10B, having front right and rear right standing legs and a right center support member, the front left and rear left standing legs and the left center support member not being shown, where the standing legs consist of an attachment section and are attached at their lower ends to a common support member, at their upper ends to bars at right angles having a horizontal extension, and center support members attached to and connecting the bars of the front right and rear right standing legs and the bars of the front left and rear left standing legs.
Figure 10D:
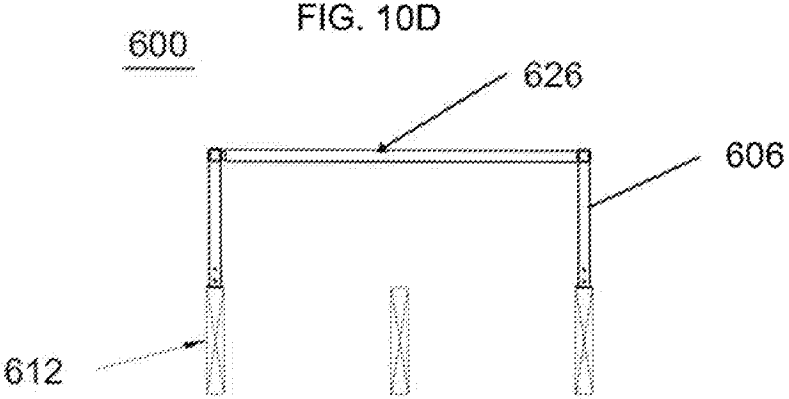
FIG. 10D is a fully retracted side view of the support unit embodiment appearing in FIG. 10C.
Figure 11A:
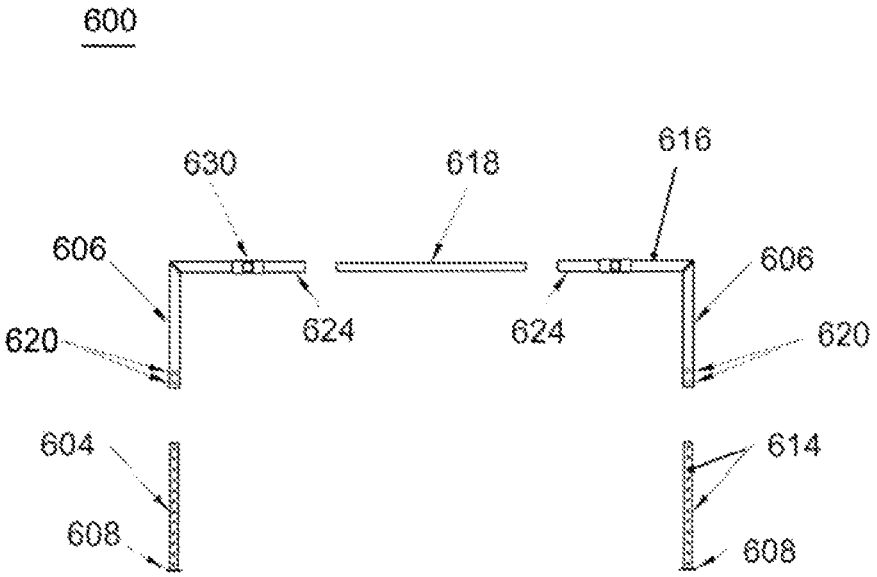
FIG. 11A is an exploded front view of the support unit embodiment appearing in FIGS. 10A-10D.
Figure 11B:
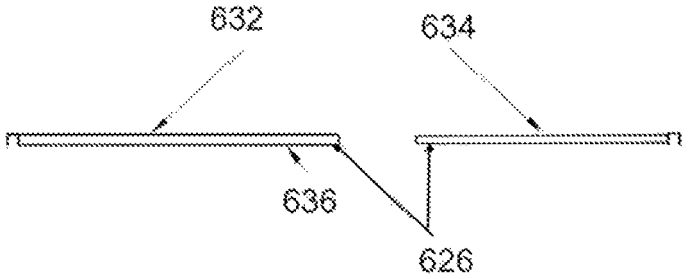
FIG. 11B is an exploded side view of the support member appearing in FIGS. 10A-10D.
Figure 12:
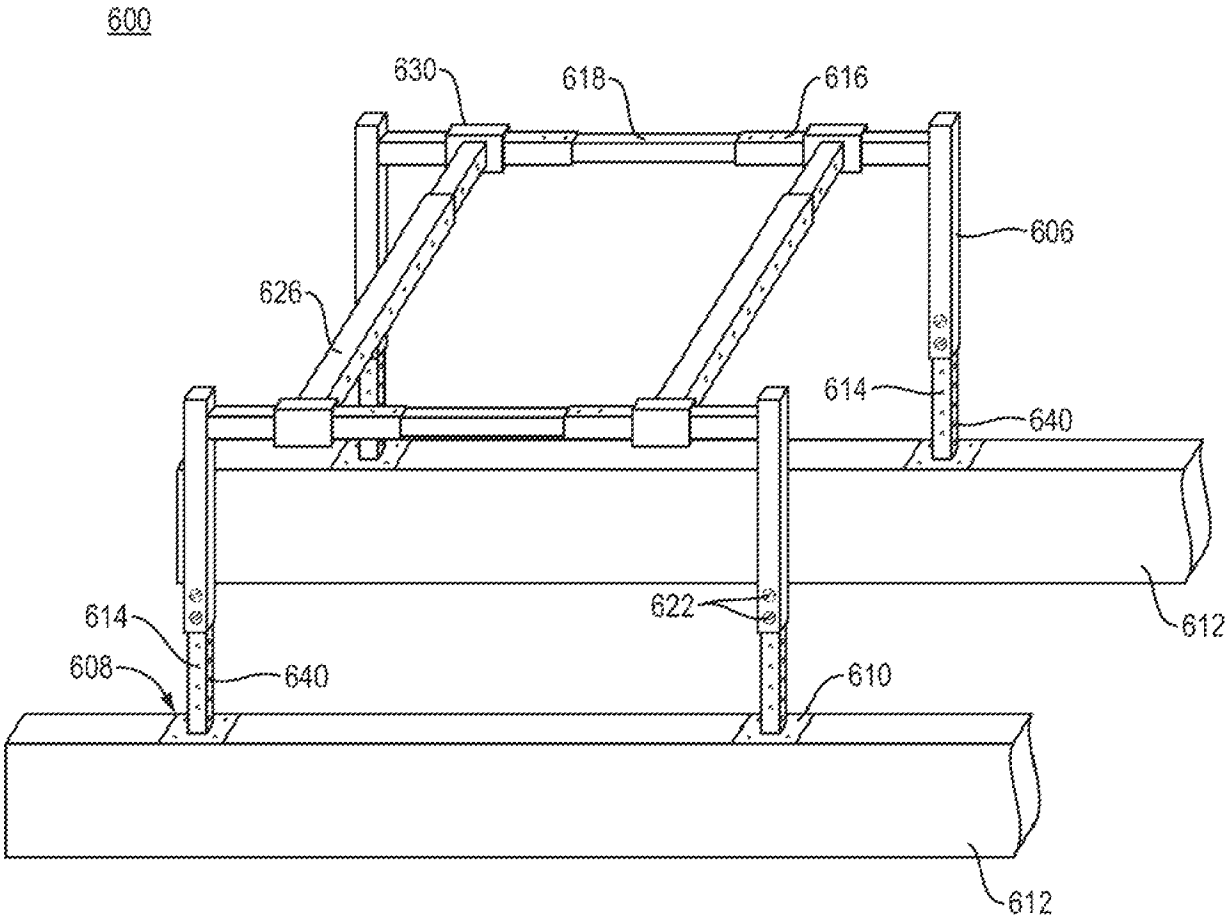
FIG. 12 is an isometric view of a support unit similar to the embodiment appearing in FIGS. 10A-10D and 11A-11B except the corner joint is a tee joint in this embodiment.

Referring now to FIG. 9, there appears yet another embodiment of the support unit 500 which may be used to provide storage shelves in the empty space found over a garage door. The support unit 500 may be sized to fit between the rails 524 for a garage door 526 and above the garage door 526 when it is in the open position to provide additional storage in the space above the garage door. The support unit 500 includes four hanging arms 502 and where each hanging arm 502 consists of an upper arm 504 and a "J" bar 506 at its lower end. The upper arms 504 may be a square tube composed of steel or another metal or metal alloy. The top of the upper arm 504 includes a first plurality of openings 508, which are sized for receiving screws, bolts, or the like for attaching the upper arms 504 to hang the support unit 500 to a steel beam, wood rafter, wood joist, wood beam, ceiling, or the like. For attachment to a finished ceiling, an attachment plate not shown may be secured to the top of each upper arm 504. The attachment plate may have a plurality of openings not shown, which are sized for receiving screws, bolts, or the like for attaching the upper arms 504 to a joist in the ceiling or anchoring the upper arms 504 into the drywall.

The upper arms 504 and horizontally extending arms 510 are of the type described above with reference to FIGS. 3-8. The upper arms 504 telescope into the J bar 506 and are secured using fasteners 516, e.g., pins, Clevis pins, nuts and bolts, or the like. The J bar 506 is of the type described above with reference to FIGS. 3-8. The arms 510 may be integral with the vertical portion of the J bar and bent to form the horizontally extending arms 510 of the J bar 506. Alternatively, the horizontal arms 510 may be separately formed and attached, e.g., by welding the horizontally extending arms 510 to the bottom of the vertical portion of the J bars 506. The extension member 512 is telescopically received within the arm 510 to obtain the desired separation between opposing J bars 506. The extension member 512 is of the type described above with reference to FIGS. 3-8.

Additional support for items to be stored above the garage door 526 is provided by a plurality of support members 518, in the preferred embodiment there are four additional support members. Although the illustrated embodiment shows four support members, it will be recognized that support members may be removed or added to provide the desired amount of support for items stored on the unit 500. The support members 518 are secured onto the arms 510 at a desired separation using coupling hooks 520. The coupling hooks 520 at the first end of the support member 518 are secured to the arms 510 at a desired point and the coupling hooks 520 at the second end of the support member 518 are secured to a parallel arm 510 the same distance from the curve of the J bar 506. In alternative embodiments fasteners, such as pins, Clevis pins, nuts and bolts, or the like may be used to secure the support members 518 to the arms 510. In another alternative embodiment, the support members 518 may be comprised of two telescopic segments. The support members 518 and coupling hooks 520 may be of the type described above with reference to FIGS. 3, 4A-4B, and 5.

The shelves created by arm 510 and extension member 512, and support members 518 are used to create additional storage in the space above an open garage door.

Referring now to FIGS. 10A-10D, 11A-11B, and 12, there appears yet another embodiment support unit 600 having four legs 602 and where each leg 602 consists of a lower leg 604 and an "L" bar 606 at its upper end. The lower legs 604 may be square tubes composed of a metal or metal alloy, such as steel. An attachment plate 608 may be secured to the bottom of each lower leg 604, e.g., via welding. The attachment plates 608 have a plurality of openings 610, four openings in the preferred exemplary embodiment, which are sized for receiving screws, bolts, or the like for attaching the lower legs 604 to the top of a steel or wood beam, floor joist, floor or the like 612.

In the present embodiment, the lower legs 604 may have a plurality of openings 614 located at spaced apart intervals (e.g., on two inch centers) on the front and rear of the square tube, and a second plurality of openings 640, are located in the preferred exemplary embodiment at spaced apart intervals (e.g., on two inch centers) on the left and right side of the square tube between the plurality of openings 614. The plurality of openings 614 and second plurality of openings 640 may be located at any desired interval based on the intended use of the support unit 600.

The lower legs 604 telescope into the L bars 606. The L bars 606 are square tubes composed of metal or metal alloy with an inside dimension which makes a sliding fit with the outside dimension of the lower legs 604. The L bars 606 have clearance openings 620 for receiving fasteners 622, such as pins, Clevis pins, thumb screws, nuts and bolts, or the like which align with the plurality of openings 614 and 640 in the lower legs 604 for attaching the L bars 606 to the lower legs 604. Located at the top of each L bar 606 is a horizontally extending arm 616 which is attached to the upright portion to form the L bars 606. The L bars 606 may be formed by welding the horizontally extending arms 616 to the top of the upper portion of the L bars 606 or alternatively may be formed by bending a single length of tubing as described above. The arms 616 are square tubes with the same width as the width of the top of the L bars 606 and may be made of steel or another metal or metal alloy. The arms 616 of the front right and front left L bars 606 and the arms 616 of the rear right and rear left L bars 606 are connected using extension members 618. The extension members 618 telescope into the horizontally extending arms 616. The arms 616 have clearance openings 624 for receiving fasteners, such as pins, Clevis pins, thumb screws, nuts and bolts, or the like for attaching the horizontally extending arms 616 to the extension members 618. Depending on the means used to secure the extension members 618 inside of the horizontally extending arms 616, the extension members 618 may include a plurality of openings 638 evenly spaced apart along the extension members 618. In the preferred exemplary embodiment the extension members 618 enable the support unit 600 to expand from approximately two feet two inches to approximately three feet two inches although other dimensions are contemplated.

One or more support members 626 may optionally be attached to the horizontal arms 616. The support members 626 are attached using coupling hooks 630. The coupling hooks 630 are attached at a first end of the support member 626 to a front horizontally extending arm 616 and at a second end of the support member 626 to the corresponding rear horizontally extending arm 616. The support members 626 and coupling hooks 630 may be of the type described above with reference to FIGS. 3, 4A-4B, and 5. The support members 626 provide additional support for the items to be stored on the support unit 600.

The support members 626 can be a set length or extendable. If the support members 626 are to be extendable they may include a first arm 632 and a second arm 634. The first and second arms 632 and 634, respectively, are square tubes made of metal or metal alloy, such as steel. The first arms 632 are preferably the same width as the width of the L bars 606. The second arms 634 are telescopically received within the first arms 632. The first and second arms 632 and 634 may have clearance openings 636 for receiving a fastener for securing the arms 632 and 634 at a defined width, such as a pin e.g., a Clevis pin, thumb screw, nut and bolt, or the like for attaching the first arms 632 to the second arms 634. Depending on the means used to secure the second arm 634 inside of the first arm 632, the second arms 634 may include a plurality of openings (not shown) evenly spaced apart along the second arms 634 to provide a plurality of sizing options. In the preferred exemplary embodiment the support members 626 may expand from two feet eight inches to four feet, although other dimensions are contemplated.

When the support unit 600 is used for an HVAC system an optional pan (not shown) may be placed under the horizontally extending arms 616 and the support members 626 and/or on the top of base support structure 612 to catch any water that may be expelled if the HVAC system is not working properly.

Figure 13:
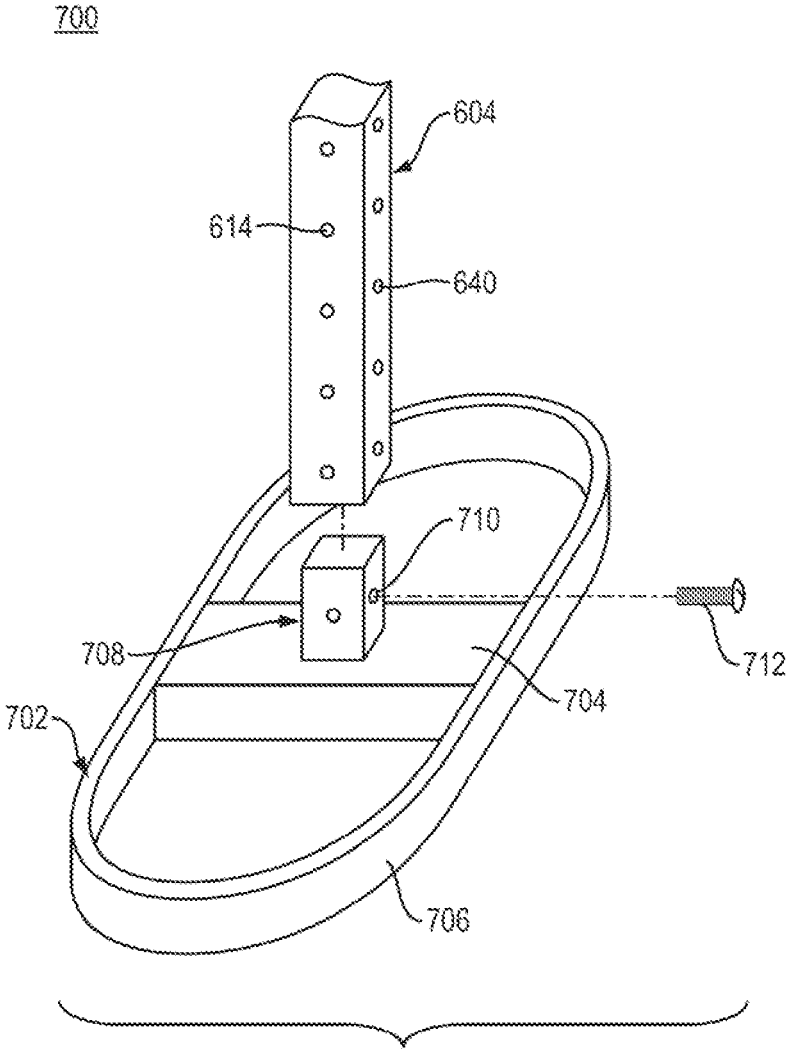
FIG. 13 is an enlarged exploded view of one of the lower legs in FIG. 12 with a first alternative embodiment base plate.

As best seen in FIG. 13, an alternative attachment mechanism 700 is shown. The embodiment 700 can be used as an alternative support member with any of the stand embodiments described above, including the embodiment 600 appearing in FIG. 12, as well as the stands appearing in FIGS. 10A-D and 11A-B, wherein the base plate is replaced with a generally oval or circular attachment foot 702 that is attached to the bottom of each lower leg 604. The attachment feet 702 may be made of steel or other metal and include a cross member 704 secured inside a frame 706. The frame 706 and cross member 704 may be secured, e.g. via welding. The cross member may have an attachment post 708 having at least one set of corresponding holes 710 for securing the lower leg 604 to the foot 702 via a fastener 712, e.g., a pin, a Clevis pin, thumb screw, nut and bolt, or the like. The frame 706 may be formed of the same tubular stock material used for the L bars 606. The cross member 704 and post 708 may be formed of a similar tubular stock material used for the L bars 606 in a smaller size to allow the lower leg 604 to fit over the post 708 thereby securing the support unit to the attachment mechanisms 700. The embodiment of FIG. 13 is especially advantageous for use in supporting an HVAC condensing unit on a flat roof, e.g., having rubber or other flat roofing material while eliminating sharp corners, thus minimizing the likelihood that the base member will puncture or damage the roof membrane.

Figure 14:
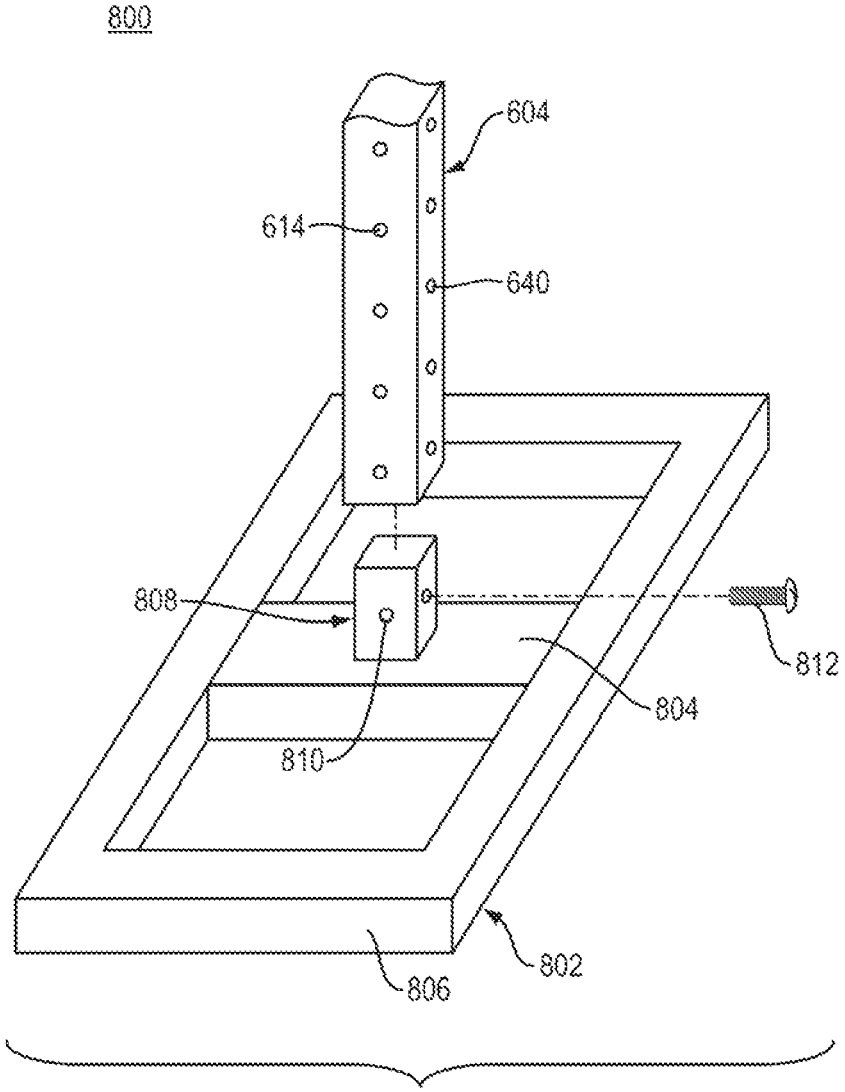
FIG. 14 is an enlarged exploded view of one of the lower legs in FIG. 12 with a second alternative embodiment base plate.

Another alternative embodiment 800, also advantageous for use on a flat roof, appears in FIG. 14. The embodiment 800 is as described above by way of reference to the embodiment 700 appearing in FIG. 13, but wherein alternative attachment feet 802 to be secured to the bottom of each lower leg 604 are generally rectangular or square. The attachment feet 802 may be formed of a steel or other metal and have a cross member 804 secured inside a frame 806. The frame 806 and cross member 804 may be secured, e.g. via welding. The cross member may have an attachment post 808 having at least one set of corresponding holes 810 for securing the lower leg 604 to the foot 802 via a fastener 812, e.g., a pin, a Clevis pin, thumb screw, nut and bolt, or the like. The frame 806 may be formed of the same tubular stock material used for the L bars 606. The cross member 804 and post 808 may be formed of a similar tubular stock material used for the L bars 606 in a smaller size to allow the lower leg 604 to fit over the post 808 thereby securing the support unit to the attachment mechanisms 800.

Figure 15:
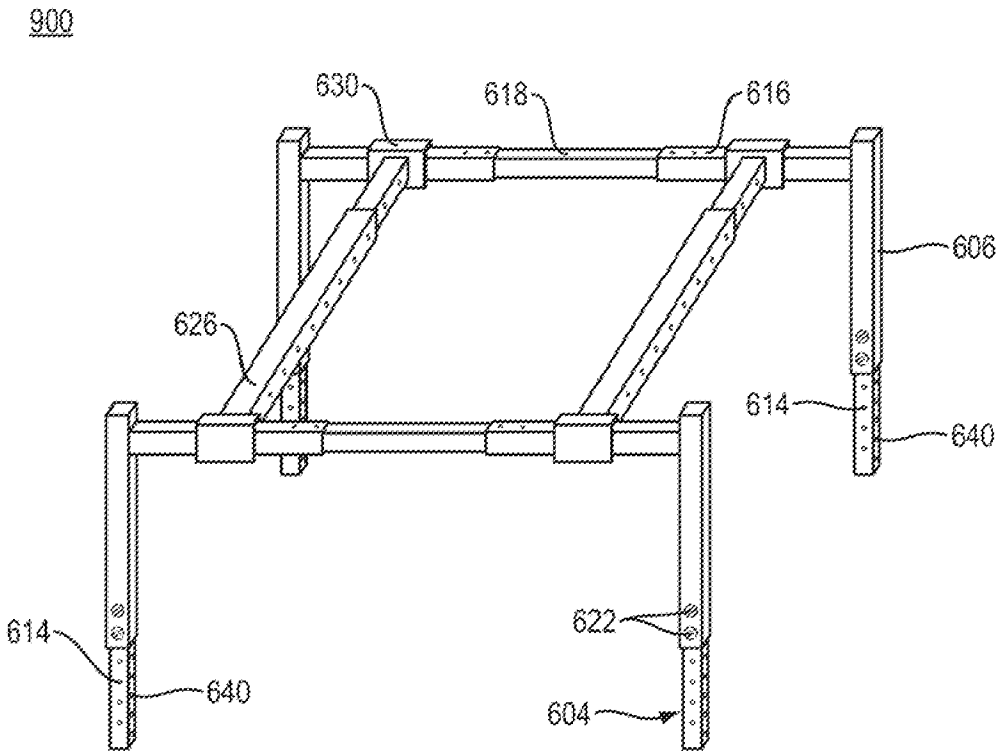
FIG. 15 is an isometric view of a further alternative embodiment of a support unit similar to the embodiment appearing in FIG. 12 wherein the base plates are omitted.

As best seen in FIG. 15, another alternative embodiment 900 of the support unit is shown. The support unit embodiment 900 is similar to the embodiment 600 appearing in FIG. 12, but is adapted for the attachment of the lower legs 604 directly to the desired attachment surface, for example using a fastener (not shown) such as a pin, a Clevis pin, thumb screw, nut and bolt, or the like. The fastener may be received within one or more of the plurality of openings 614 and the second plurality of openings 640 and secured to the attachment surface. Alternatively, the fasteners may be omitted and the unit 900 may rest directly on the support surface.

Figure 16:
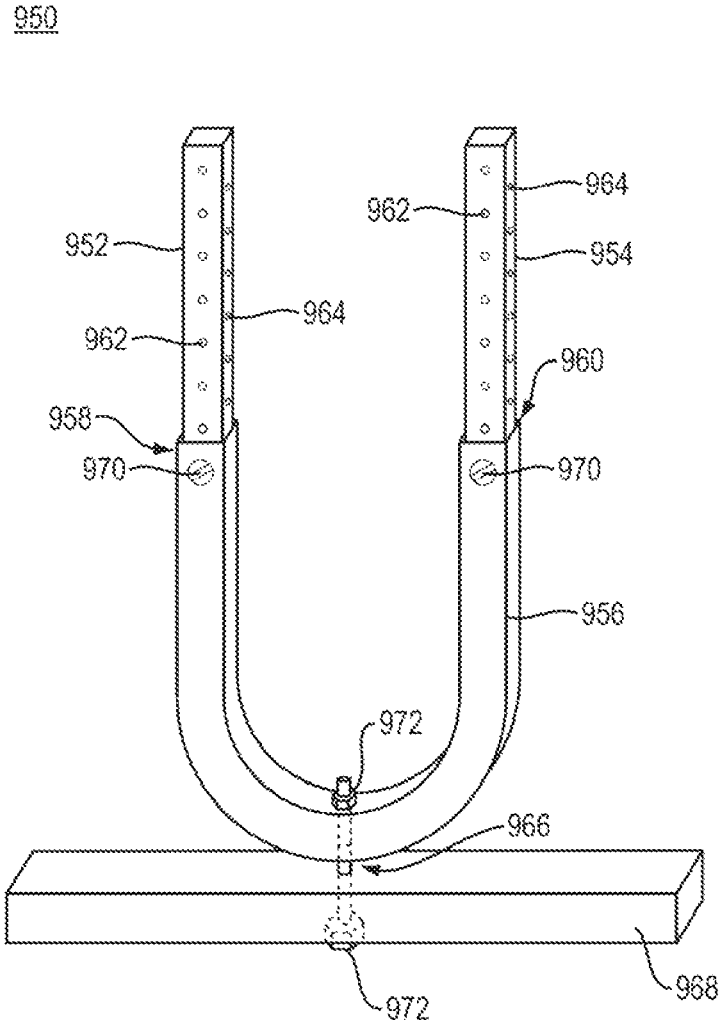

Referring now to FIG. 16, there appears a further embodiment support unit 950 having upper hanging arms 952 and 954 which each mate with an end of a "U" bar 956. The hanging arm 952 mates with a first end 958 of the U-bar 956 and hanging arm 954 mates with a second end 960 of the U-bar 956. The hanging arms 952 and 954 are square tubes composed of steel or another metal/metal alloy and having a first plurality of openings 962 on the front and rear of the hanging arms 952 and 954, which are sized for receiving screws, bolts, or the like for attaching the hanging arms 952, 954 to hang the support unit 950 to a steel beam, wood rafter, wood joist, wood beam, ceiling, or the like at a first end and to secure the hanging arms 952 and 954 to the U-bar 956 at a second end. If the first plurality of openings 962 does not align with the desired support member the hanging arms 952 and 954 may be rotated ninety degrees to align with the desired support member for attachment using a screw, bolt, or the like. Alternatively, the arms 952 and 954 may have a second plurality of openings 964, as shown in FIG. 16, offset from the first plurality of openings 962 which are sized for receiving screws, bolts, or the like for attaching the hanging arms 952 and 954 to hang the support unit 950 to a steel beam, wood rafter, wood joist, wood beam, ceiling, or the like and to secure the hanging arms 952 and 954 to the U-bar 956 at a second end. The hanging arms 952 are secured to the U-bar 956 via fasteners 970, for example, pins, Clevis pins, thumb screws, nuts and bolts, or the like.

In the present embodiment, the first plurality of openings 962 are located at spaced apart intervals (e.g., on two inch centers) on the front and rear of the square tube, and the second plurality of openings 964, are located at spaced apart intervals (e.g., on two inch centers on the left and right side of the square tube offset from the first plurality of openings 962. The first and second plurality of openings 962 and 964, respectively, are located at a desired interval for the intended use of the support unit 950. The hanging arms 952 and 954 telescope into the U-bar 956. The U-bar 956 may be a square tube bent into a U shape and composed, for example, of steel or other metal or metal alloy with an inside dimension which makes a sliding fit with the outside dimension of the hanging arms 952 and 954.

Located at the bottom of the U-bar 956 is an attachment opening 966 for attaching a rotating support member 968, such as a fastener, bracket, or the like, for securing a HVAC unit, television and audio visual equipment, hanging storage units, pot racks, and the like to the support unit 950. The rotating support member 968 is secured to the U-bar 956 via a fastener 972, for example, pins, Clevis pins, thumb screws, nuts and bolts, or the like, which enables the support member 968 to rotate 360 degrees about the fastener 972.

Figure 17:
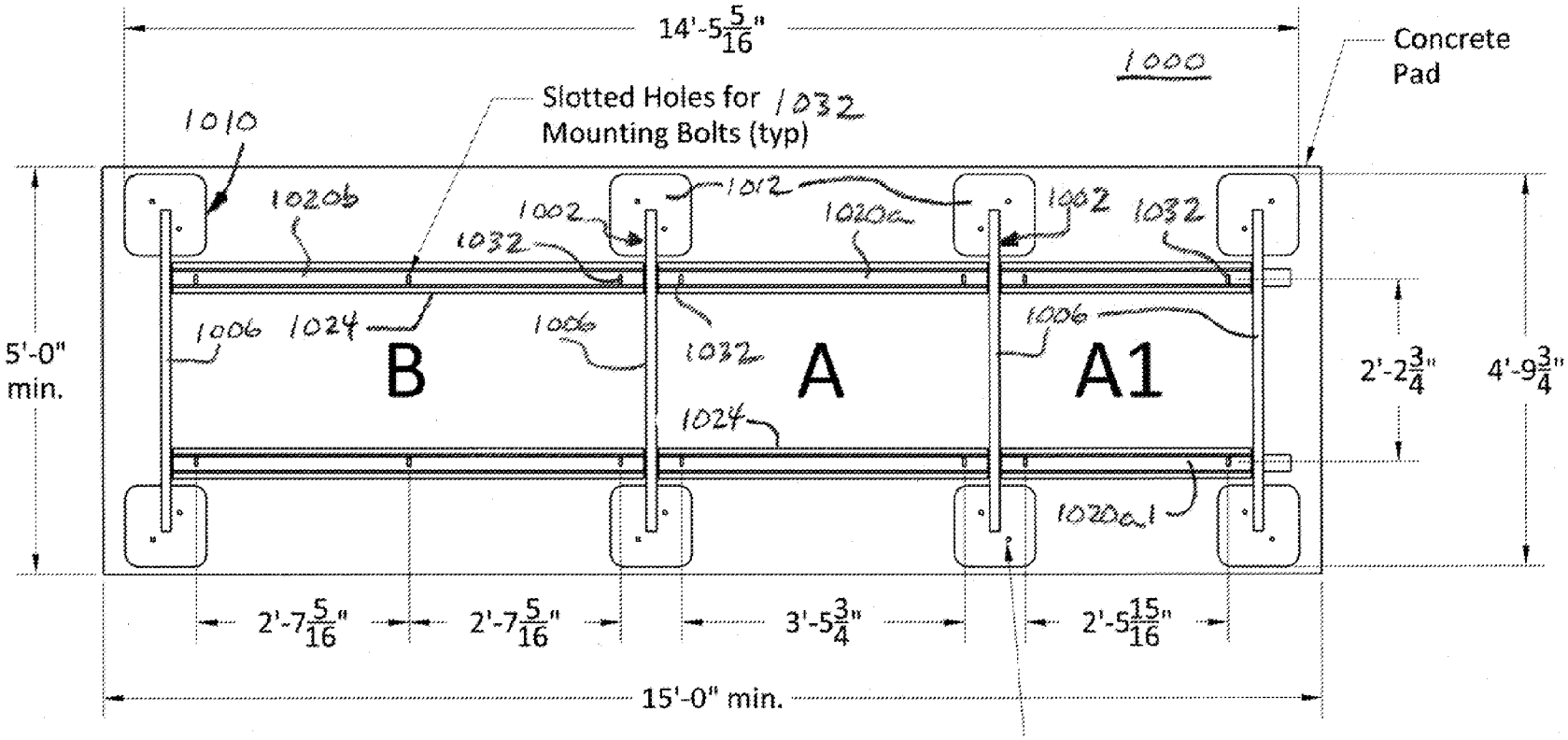
FIG. 17 is a top plan view of yet a further stand embodiment.
Figure 18:
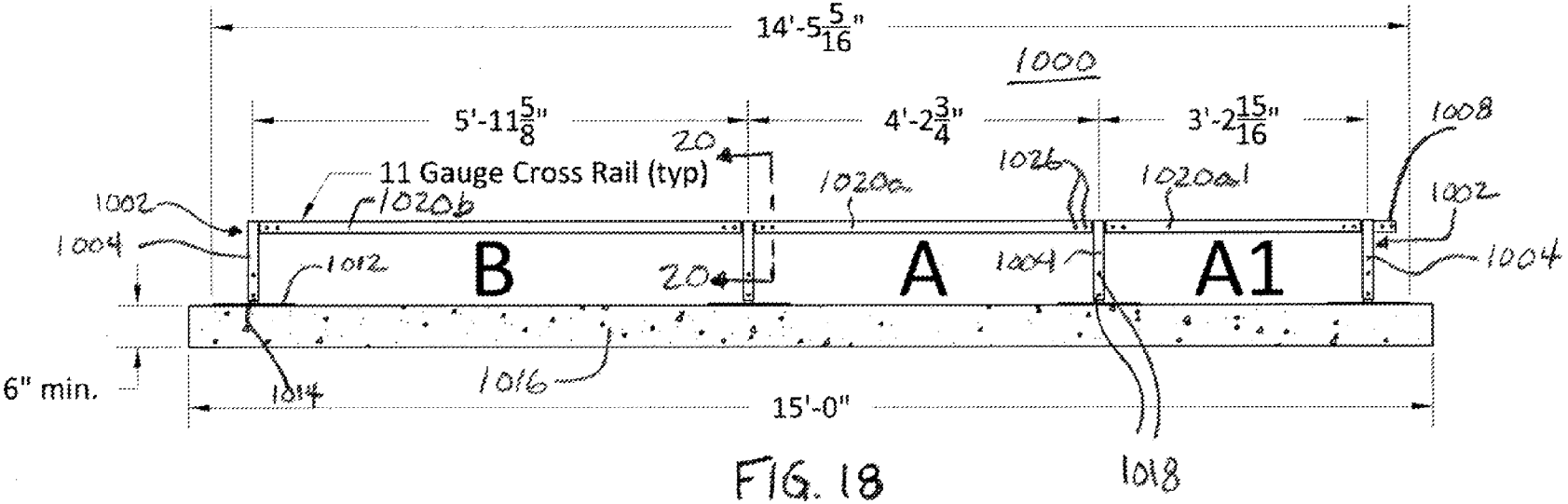
FIG. 18 is side elevational view of the embodiment appearing in FIG. 17.
Figure 19:
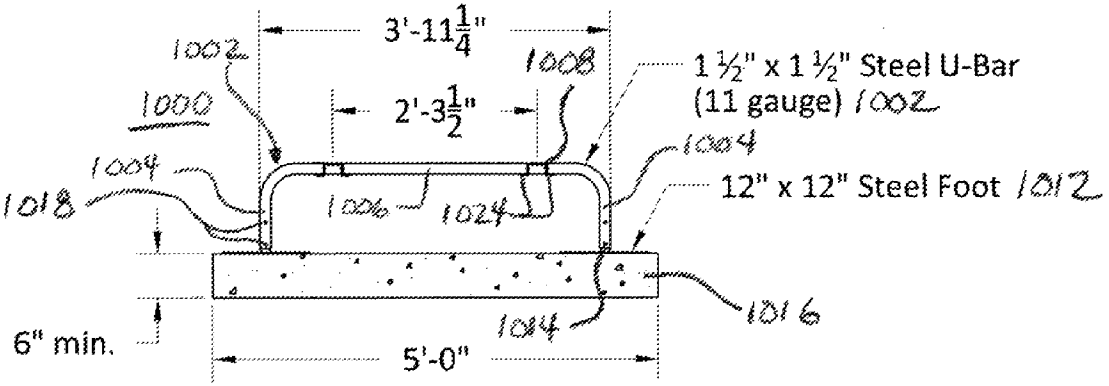
FIG. 19 is an end view of the embodiment appearing in FIG. 17.

Referring now to FIGS. 17-19, a further exemplary stand embodiment 1000 herein is illustrated. The stand appearing in FIGS. 17-19 is adapted for HVAC systems that need to be elevated above the ground or roof, and particularly modular HVAC system such as the CITY MULTI® HVAC systems available from Mitsubishi Electric, although it will be recognized that the present system could be adapted for other HVAC systems that are similar in terms of physical size, design, and function, including other variable refrigerant flow (VRF) units from other manufacturers including Carrier, Trane, Toshiba, Daikin, Fujitsu, LG, Panasonic, and others. Likewise, it will be recognized that all dimensions appearing in the drawings are exemplary and explanatory only and are not intended to be limitative of the present invention.

The stand includes a plurality of leg members 1002 axially spaced apart. Each leg member 1002 is generally an inverted U-shape and includes first and second generally vertical legs 1004 and a generally horizontal cross beam 1006 extending transversely therebetween. Although the leg members are illustrated as having a fixed width, the leg members may alternatively have a telescoping adjustable width, e.g., as depicted in FIGS. 10A-12 and 15, exemplary embodiments of which appear in FIGS. 24-34, described below.

The horizontal beam 1006 includes a first set of transversely spaced apart seats or pegs 1008 (two in the embodiment shown) secured to the beam 1006. The pegs 1008 may be welded to the horizontal beam 1006. The first set of pegs 1008 extend in one axial direction. A second set of pegs 1008 aligned with the first set of pegs 1008 extend on the opposite axial direction. The second set of pegs 1008 may be omitted for leg members forming the terminus of the stand. The pegs 1008 may be formed of bent steel and, in the illustrated embodiment, have a generally U-shaped cross-section, although it will be recognized that other configurations are possible.

The leg members 1002 may be formed of tubular steel, e.g., 1.5 inch×1.5 inch 11 gauge steel bar. Each vertical leg 1004 includes an associated foot 1010 comprising a plate 1012 and a vertical post 1014. The plates 1012 may have a relatively large surface area to distribute the weight of an HVAC system supported on the stand. For example, the plates 1012 may be 12 inch×12 inch steel plates, although other sizes are contemplated. The plates 1012 have openings 1015 adapted to receive fasteners to secure the foot 1010 to a surface 1016. The surface 1016 may be a concrete pad. Other surfaces are also contemplated, such as building roofs and others. The fasteners may be, for example, ½ inch bolts embedded in the surface and extending through the openings 1015 in the plate to allow the plate 1012 to be bolted to the surface.

The upstanding post 1014 is telescopically received in the bottom of the vertical leg 1004. The post 1014 is secured with one or more threaded fasteners 1018 passing through aligned openings in the post 1014 and the vertical leg portion 1004 to secure the post 1014 and the leg 1004 in fixed position. In alternative embodiments (not shown), the plates 1012 are secured to the lower end of the vertical legs 1004 via welding. In still further alternative embodiments, the post 1014 and the vertical leg 1004 may be telescopically secured at a plurality of positions to provide a height adjustable stand in the manner described above.

Two transversely spaced apart cross rails **1020*b*, 1020*a*, and 1020*a* 1, and designated herein generally as 1020, extend between each adjacent pair of leg members 1002. Each cross rail rests on a corresponding pair of transversely aligned pegs 1008. The cross rails 1020 may have an inverted U-shaped cross-section, and more preferably are formed of a hat channel having a generally hat shaped cross-sectional shape comprising an inverted U shaped portion 1022 defining a channel for receiving the pegs and outward extending axial flanges or fins 1024. The cross rails 1020 may be of a roll-formed steel construction. Fasteners 1026 extend through openings 1028 in the cross rails 1020 and openings 1030 in the pegs 1008 to secure the cross rails 1020 to the horizontal beam portions 1006 of the leg members 1002. Each cross rail 1020 may have one or more openings 1032** in the upper surface to receive mounting bolts or other fastening hardware to secure the HVAC system to the stand.

As noted above, the stand herein can be advantageously used with modular HVAC systems, e.g., HVAC systems of the type having HVAC modules of different heating or cooling capacities that can be used individually, or, can be used in combination to create an HVAC system with increased capacity. The present system is especially advantageous for use with the Mitsubishi CITY MULTI® HVAC systems which comprise modular HVAC units which can be readily combined in the field to create larger capacity systems. By way of example only, the CITY MULTI® product line includes the following 11 heat pump models shown in Table 1, including 4 modular units that can be used individually as well as at least 7 systems which combine the modular components to create larger capacity systems:

TABLE 1

| Model | Cooling Capacity (BTU/hour) | Component Models | |
|---|---|---|---|
| PURY-P72YKMU-A (-BS) | 69,000 | — | — |
| PURY-P96YKMU-A (-BS) | 92,000 | — | — |
| PURY-P120YKMU-A (-BS) | 114,000 | — | — |
| PURY-P144YKMU-A (-BS) | 137,000 | — | — |
| PURY-P144YSKMU-A (-BS) | 137,000 | PURY-P72YKMU-A(-BS) | PURY-P72YKMU-A(-BS) |
| PURY-P168YSKMU-A (-BS) | 161,000 | PURY-P96YKMU-A(-BS) | PURY-P72YKMU-A(-BS) |
| PURY-P192YSKMU-A (-BS) | 183,000 | PURY-P96YKMU-A(-BS) | PURY-P96YKMU-A(-BS) |
| PURY-P216YSKMU-A (-BS) | 206,000 | PURY-P120YKMU-A(-BS) | PURY-P96YKMU-A(-BS) |
| PURY-P240YSKMU-A (-BS) | 228,000 | PURY-P120YKMU-A(-BS) | PURY-P120YKMU-A(-BS) |
| PURY-P264YSKMU-A (-BS) | 251,000 | PURY-P144YKMU-A(-BS) | PURY-P120YKMU-A(-BS) |
| PURY-P288YSKMU-A (-BS) | 274,000 | PURY-P144YKMU-A(-BS) | PURY-P144YKMU-A(-BS) |

In especially preferred embodiments, a modular system can be provided, wherein stand segments having cross rails with a first length "B" and stand segments having a second length "A" can be combined in various combinations to produce stands adapted to accommodate HVAC systems of various capacities. A third cross rail length "A1" (see FIGS. 17 and 18) may also be provided to provide still further expanded capacity. By providing two or more standard cross rail lengths which can be combined in multiple combinations, the system can be tailored to a wide variety of HVAC systems while reducing manufacturing costs as compared to custom or dedicated stands.

For example, in the illustrated preferred embodiment adapted for the CITI MULTI® HVAC systems, the cross rail length B may be selected to produce a stand segment having an axial length of about 71⅝ inches on center and the cross rail length A may be selected to produce a stand segment having an axial length of about 50¾ inches on center. The third cross rail length A1 may be selected to product a stand segment having an axial length of about 38 15/16 inches on center.

As shown in FIGS. 21A-21E, using only cross rail lengths A and B, the 5 combinations shown in FIGS. 21A-21E can be produced which can accommodate all 11 models shown in Table 1, while also providing an appropriate spacing between adjacent modules. For example, the stand 1000*a* comprising one segment having cross rails 1020*a* of length A appearing in FIG. 21A will accommodate the models PURY-P72YKMU-A (-BS) and PURY-P96YKMU-A (-BS). The stand 1000*b* comprising one segment having cross rails 1020*b* of length B appearing in FIG. 21B will accommodate the models PURY-P120YKMU-A (-BS) and PURY-P144YKMU-A (-BS). The stand 1000*c* comprising two stand segments, each having cross rails 1020*a* of length A appearing in FIG. 21C will accommodate the models PURY-P144YSKMU-A (-BS), PURY-P168YSKMU-A (-BS) and PURY-P192YSKMU-A (-BS). The stand 1000*d* comprising one stand segment having cross rails 1020*a* of length A and one segment having cross rails 1020*b* of length B appearing in FIG. 21D will accommodate the model PURY-P216YSKMU-A (-BS). The stand 1000*e* comprising two segments having cross rails 1020*b* of length B appearing in FIG. 21E will accommodate the models PURY-P240YSKMU-A (-BS), PURY-P264YSKMU-A (-BS), and PURY-P288YSKMU-A (-BS). Still further configurations are possible with systems employing three or more cross rail lengths.

Figure 22:
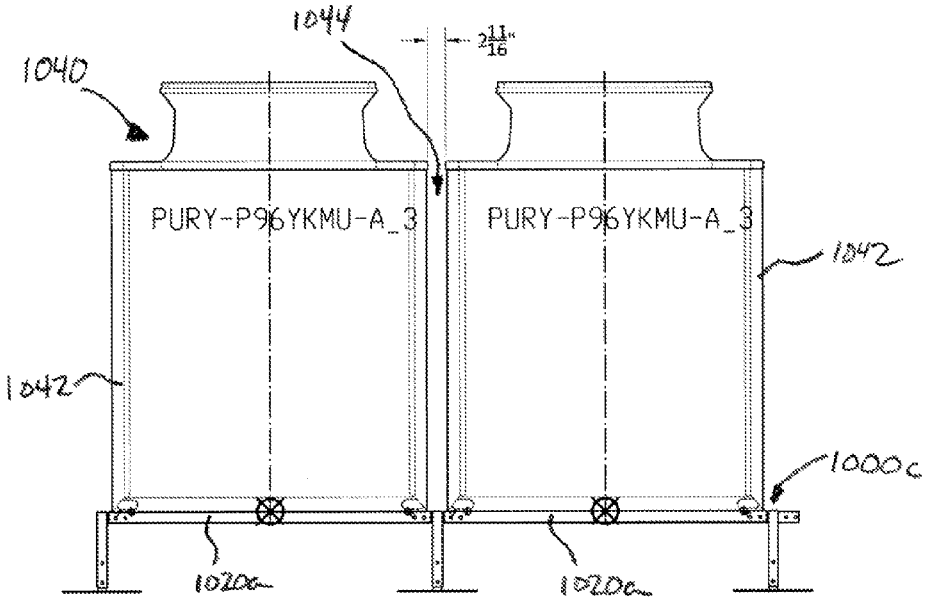
FIG. 22 is side view of an exemplary system carrying a first multi-module HVAC system.

The cross rail lengths are also selected to provide an adequate spacing between adjacent modules in multi-unit systems. For example, as shown in FIG. 22, there appears the stand 1000*c* of FIG. 21C, comprising two segments having cross rails 1020*a* of length A. The stand 1000*c* is shown with an HVAC system 1040, which is a CITY MULTI® model PURY-P192YSKMU-A comprising two PURY-P96YKMU-A modules 1042 twinned together. A space 1044 is provided between the adjacent modules 1042.

Figure 21C:
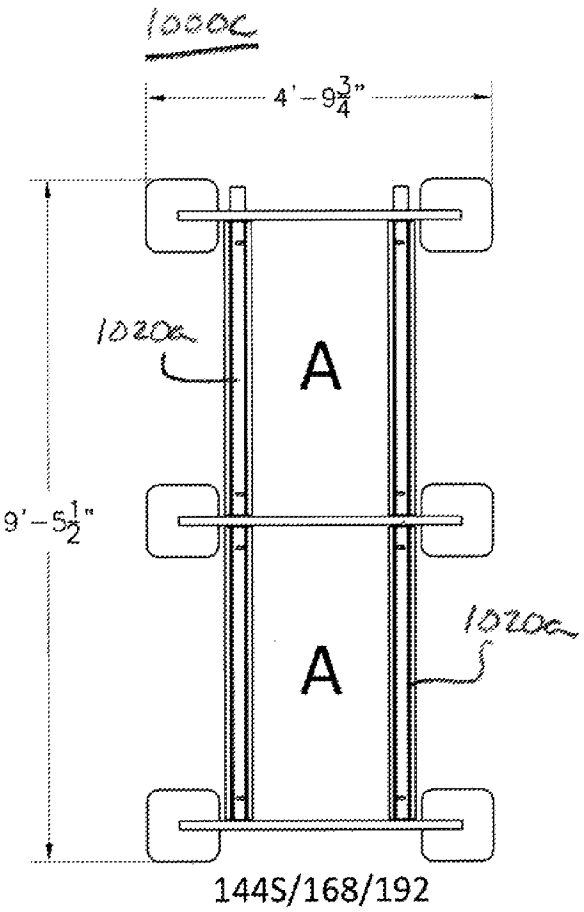
FIGS. 21A-21E illustrate the manner in which a modular system consisting of two segment lengths can be adapted for myriad HVAC configurations.
Figure 21B:
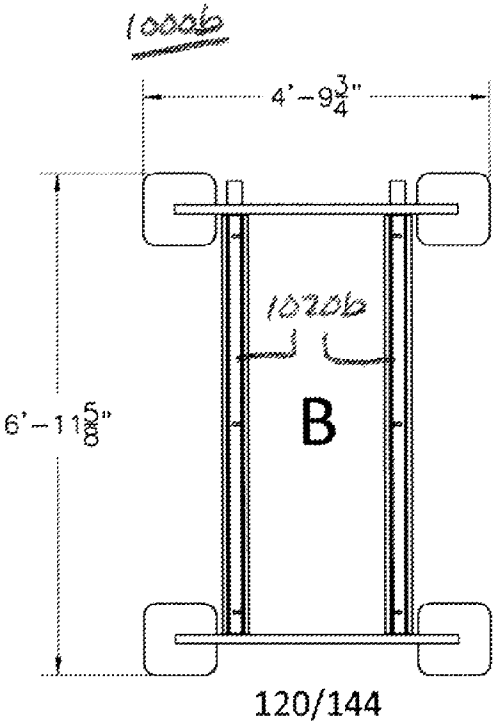
Figure 21A:
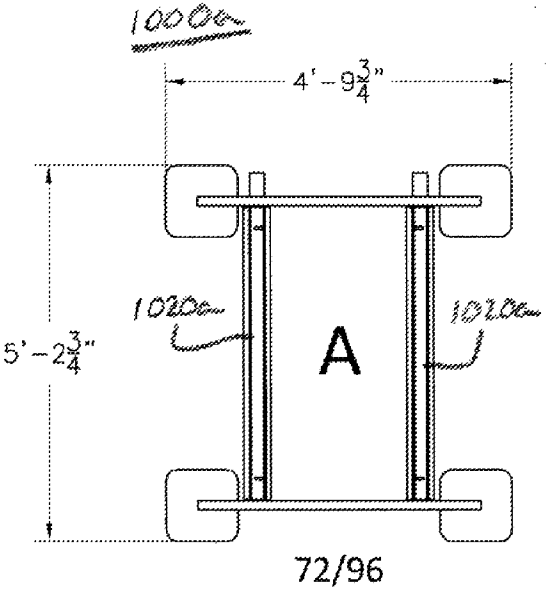
Figure 21E:
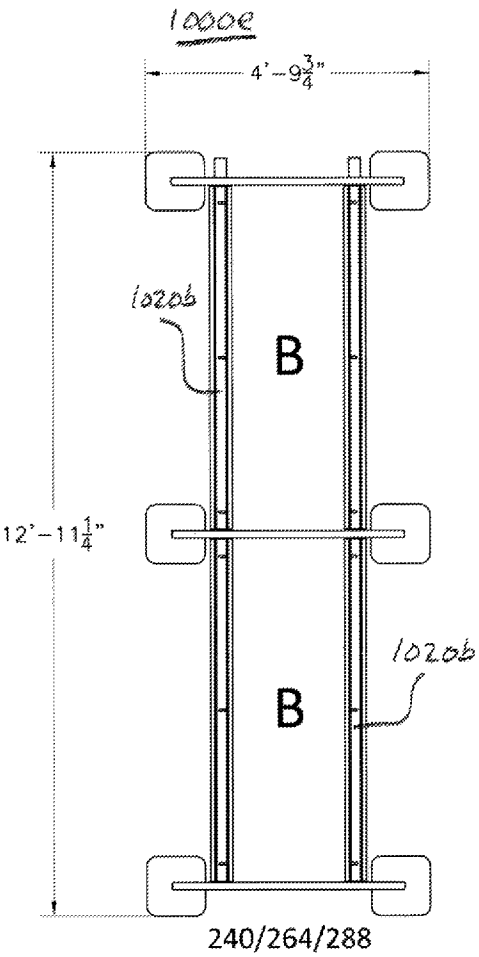
Figure 21D:
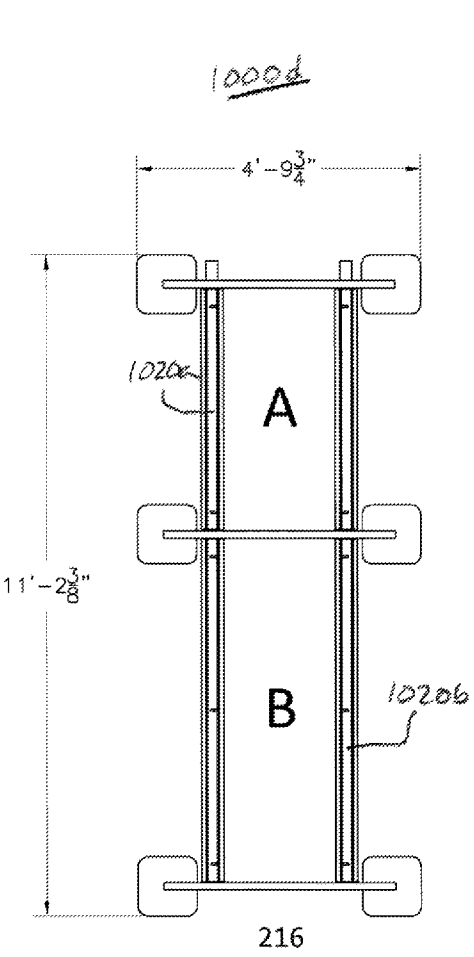
Figure 23:
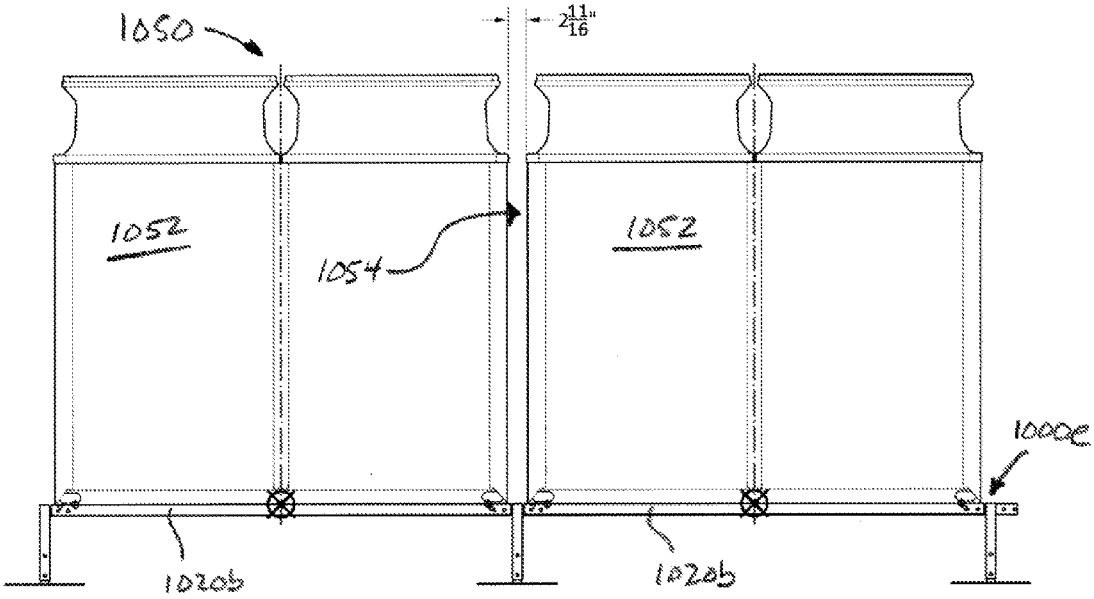
FIG. 23 is side view of an exemplary system carrying a second multi-module HVAC system.
Figure 24:
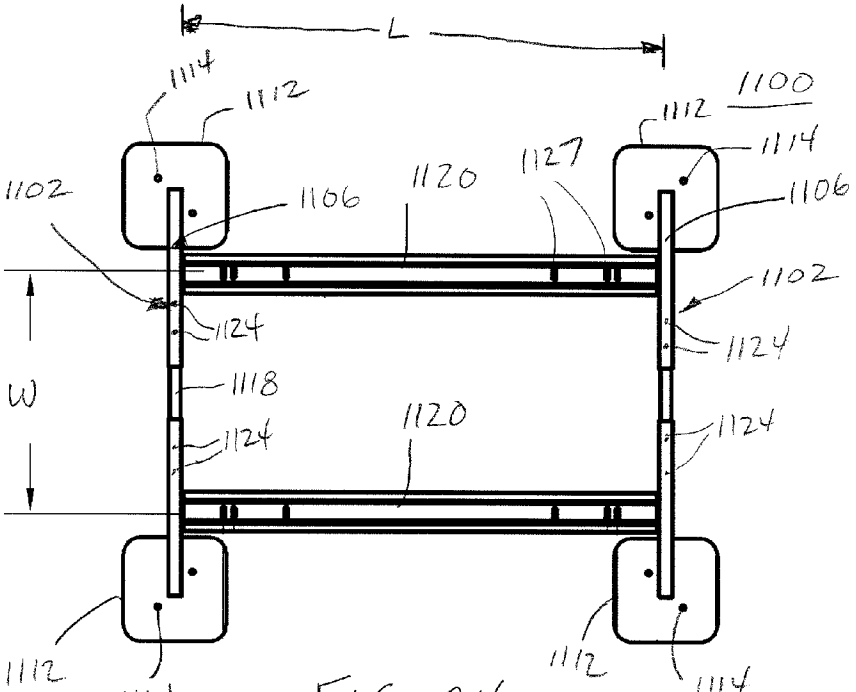
FIG. 24 is a top plan view of an adjustable width embodiment similar to the embodiment appearing in FIG. 21A.
Figure 25:
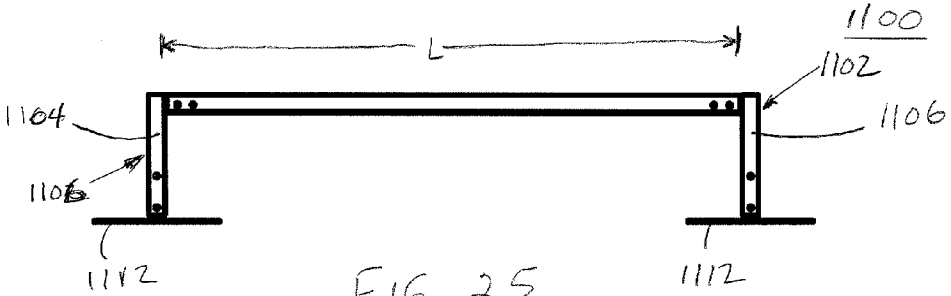
FIG. 25 is side elevational view of the embodiment appearing in FIG. 24.
Figure 26:
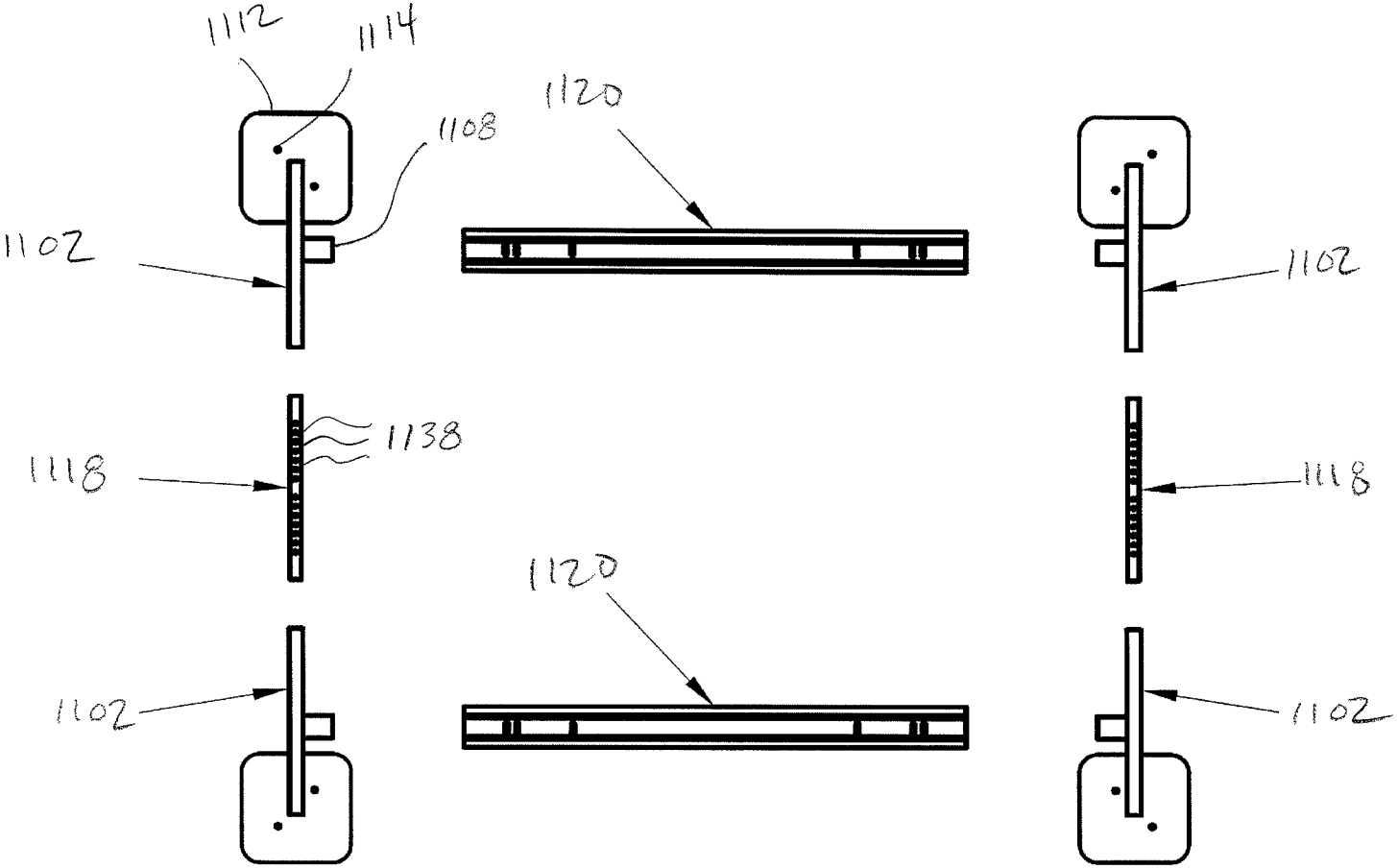
FIG. 26 is top exploded view of the embodiment appearing in FIG. 24.

As shown in FIG. 23, the stand 1000*e* of FIG. 21E, comprising two segments having cross rails 1020*b* of length B. The stand 1000*e* is shown with an HVAC system 1050, which is a CITI MULTI® model PURY-P288YSKMU-A comprising two PURY-P144YKMU-A modules 1052 twinned together. A space 1054 is provided between the adjacent modules 1052. It will be recognized that the present development could be adapted for use with other CITY MULTI® models, as well as other modular HVAC systems from other manufacturers.

Referring now to FIGS. 24-26 and 33-34, there is shown a further embodiment stand 1100 which is similar to the embodiment appearing in FIG. 21A. The stand includes a plurality of leg members 1102 axially spaced apart, and which may be of similar construction to the leg members 602 described above by way of reference to FIGS. 10A-12 and 15. Two adjacent leg members 1102 include are adjoined by a telescoping extension member 1118 and cooperate to define a generally U-shaped leg member. The J-shaped members 1102 preferably have a vertical portion 1104 transitioning to a horizontal portion 1106 via a section having a relatively large radius of curvature 107. This radius of curvature in the preferred embodiment allows the support members 1120 to be positioned inwardly of the legs and feet to provide a high degree of stability, e.g., under windy conditions.

Each leg member 1102 has a lower post 1114 telescopically received within a lower end of a vertical portion 1104 thereof. The members 1104, 1106 may be formed of square tubes composed of a metal or metal alloy, such as steel, e.g., e.g., 1.5 inch×1.5 inch 11 gauge steel bar. An attachment plate 1112 may be secured to the bottom of each lower post 1114, e.g., via welding. The attachment plates 1112 have a plurality of openings 1114 which are sized for receiving screws, bolts, or the like for attaching the unit 1100 to the surface on which it is mounted, which may be a concrete pad, building roof, and so forth. The plates 1112 may have a relatively large surface area to distribute the weight of an HVAC system supported on the stand. For example, the plates 1112 may be 12 inch×12 inch steel plates, although other sizes are contemplated. The fasteners may be, for example, ½ inch bolts embedded in the surface and extending through the openings 1114 in the plate to allow the plate 1112 to be bolted to the surface.

Figure 33:
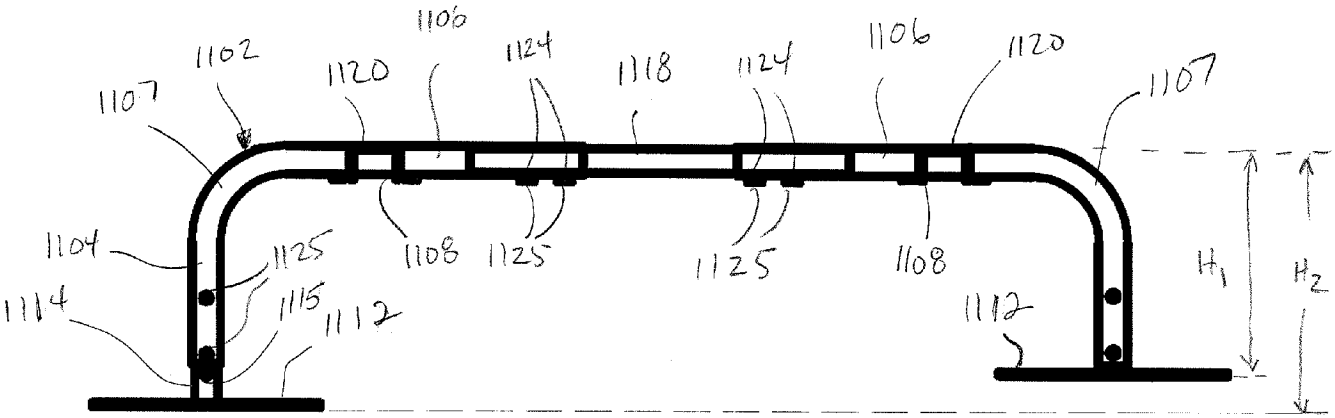
FIGS. 33 and 34 are end views illustrating the extended and retracted width adjustments, respectively, and are generally applicable to the embodiments of FIGS. 24-32.
Figure 34:
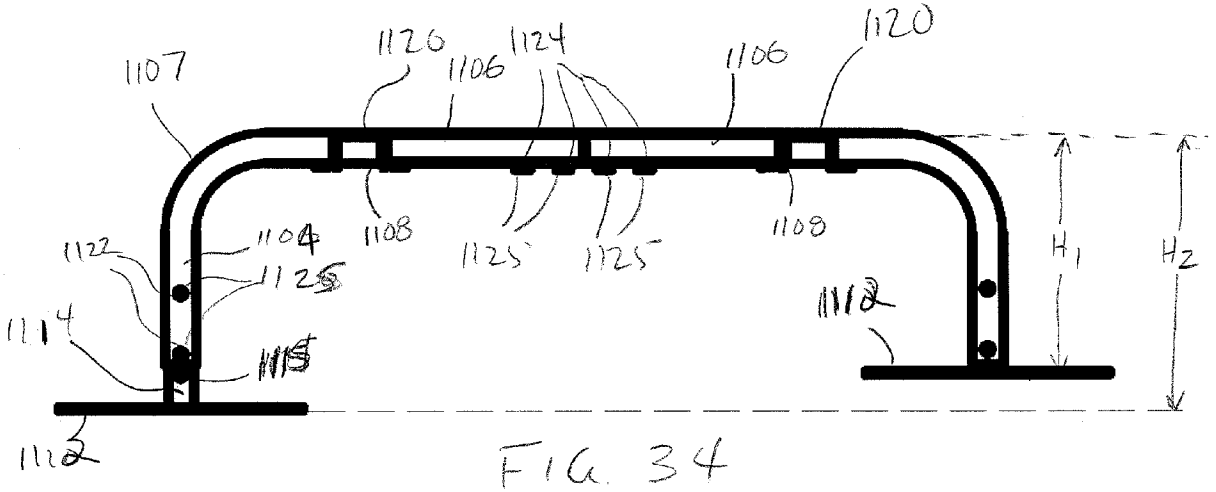

In the present embodiment, the lower legs 1104 may have a plurality of clearance openings 1122 located at spaced apart intervals and may be located at any desired interval to provide an telescoping adjustable range of heights the support unit 1100 as described above. The manner of adjusting the height of the legs between a height H1 and a height H2 is illustrated in FIGS. 33 and 34.

The post 1114 telescopes into the corresponding vertical leg portion 1104, which may be a square tube formed of metal or metal alloy with an outer dimension which makes a sliding fit with the inside dimension of the lower legs 1114. The post 1114 has clearance openings 1115 for receiving fasteners 1125, such as pins, Clevis pins, thumb screws, nuts and bolts, or the like which align with the plurality of openings 1122 in the lower legs 1104 for securing the lower legs 1104 at a desired position in the lower portion 1103. It will be recognized that fixed height embodiments, e.g., wherein the plates 1112 are affixed directly to the leg portion 1104 are also contemplated.

Each member 1102 includes a horizontally extending arm portion 1106. In some embodiments, the member 1102 may be formed by welding the horizontally extending arm 1106 to the leg portion 1104 although in more preferred embodiments, the member 1102 is formed by bending a single length of tubing as described above to define a radius of curvature 107 between the portion 1104 and the portion 1106.

The horizontal portions 1106 of opposing leg members 1102 are connected using an extension member 1118. The extension member 1118 telescopes into each of the adjacent and opposing horizontally-extending arms 1106 to provide an adjustable width W. The arms 1106 have clearance openings 1124 for receiving fasteners 1125, such as pins, Clevis pins, thumb screws, nuts and bolts, or the like for attaching the horizontally extending arms 1106 to the extension member 1118, e.g., via a plurality of openings 1138 spaced along the extension member 1118. In the preferred exemplary embodiment the extension member 1118 enables the support unit 1100 to expand in width from approximately 3-3½ feet to in the retracted position (see FIG. 34) to about 4-4½ feet in the extended position (see FIG. 33), although other dimensions are contemplated.

The horizontal portions 1106 each include at least one peg 1108 secured thereto. The peg 1108 may be welded to the horizontal beam 1106 and extend in an axial direction. A second peg 1108 may optionally be transversely aligned with the first peg 1108 1108 and extend in the opposite axial direction. The second peg may be omitted for leg members 1102 forming a terminus of the stand.

Figure 20:
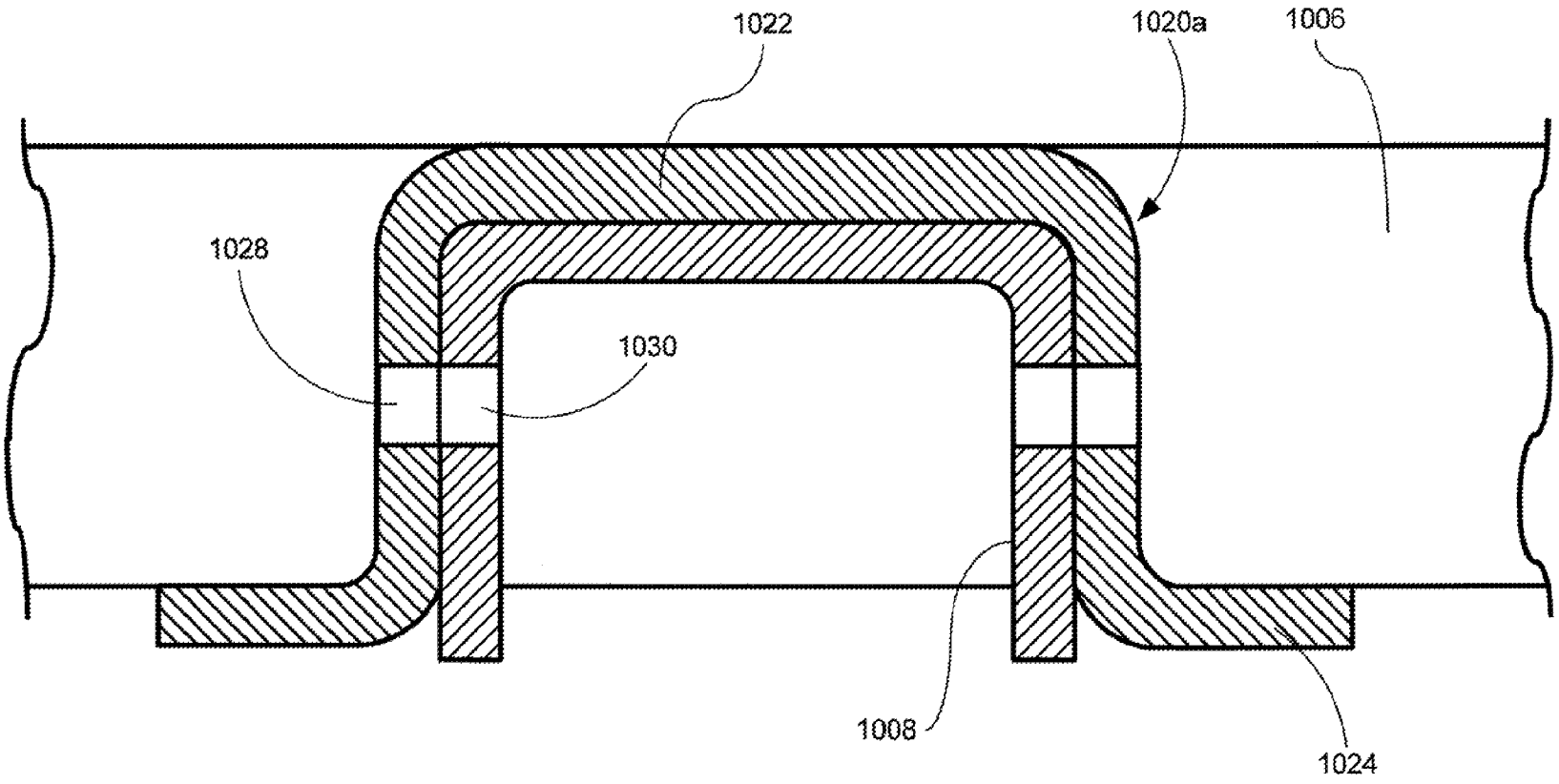
FIG. 20 is an enlarged, fragmentary, side cross-sectional view taken along the lines 20-20 in FIG. 18.

Two transversely spaced apart cross rails 1120 extend between each adjacent pair of horizontal arms 1106. Each cross rail 1120 rests on a corresponding pair of transversely aligned pegs 1108. The cross rails 1120 may have an inverted U-shaped cross-section, and more preferably are formed of a hat or flange channel and may be as described above by way of reference of FIG. 20. The axial length of the unit 1100 is selected by selection of the axial length L of the cross rails 1120. Openings 1127 in the cross rails 1120 may be provided to receive fasteners for securing the equipment to the stand. Fasteners 1129 secure the cross rails 1120 to the pegs 1108.

Figure 27:
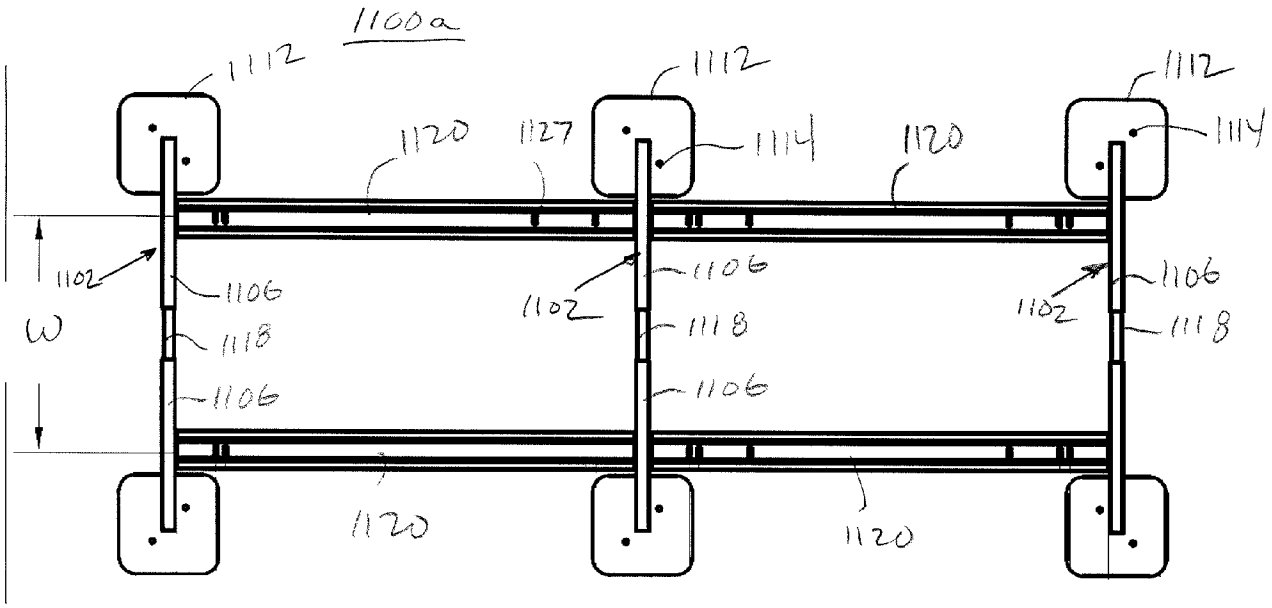
FIG. 27 is a top plan view of an adjustable width embodiment similar to the embodiment appearing in FIG. 21C.
Figure 28:
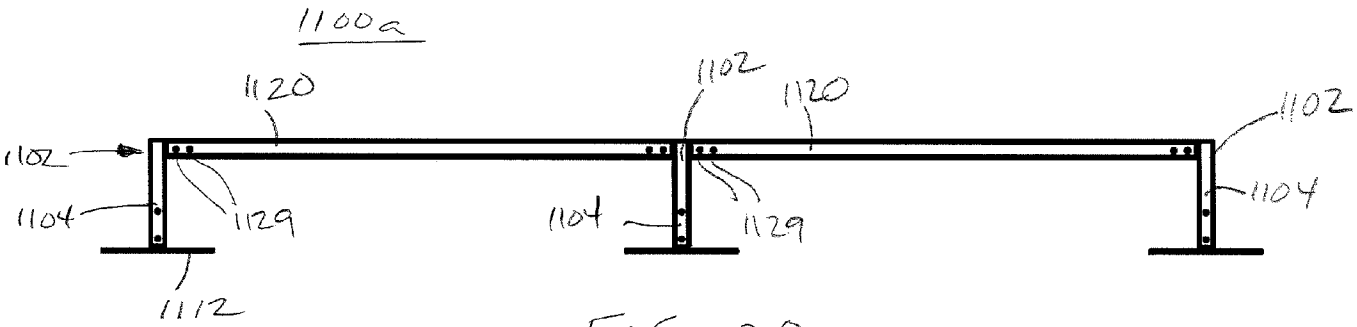
FIG. 28 is side elevational view of the embodiment appearing in FIG. 27.
Figure 29:
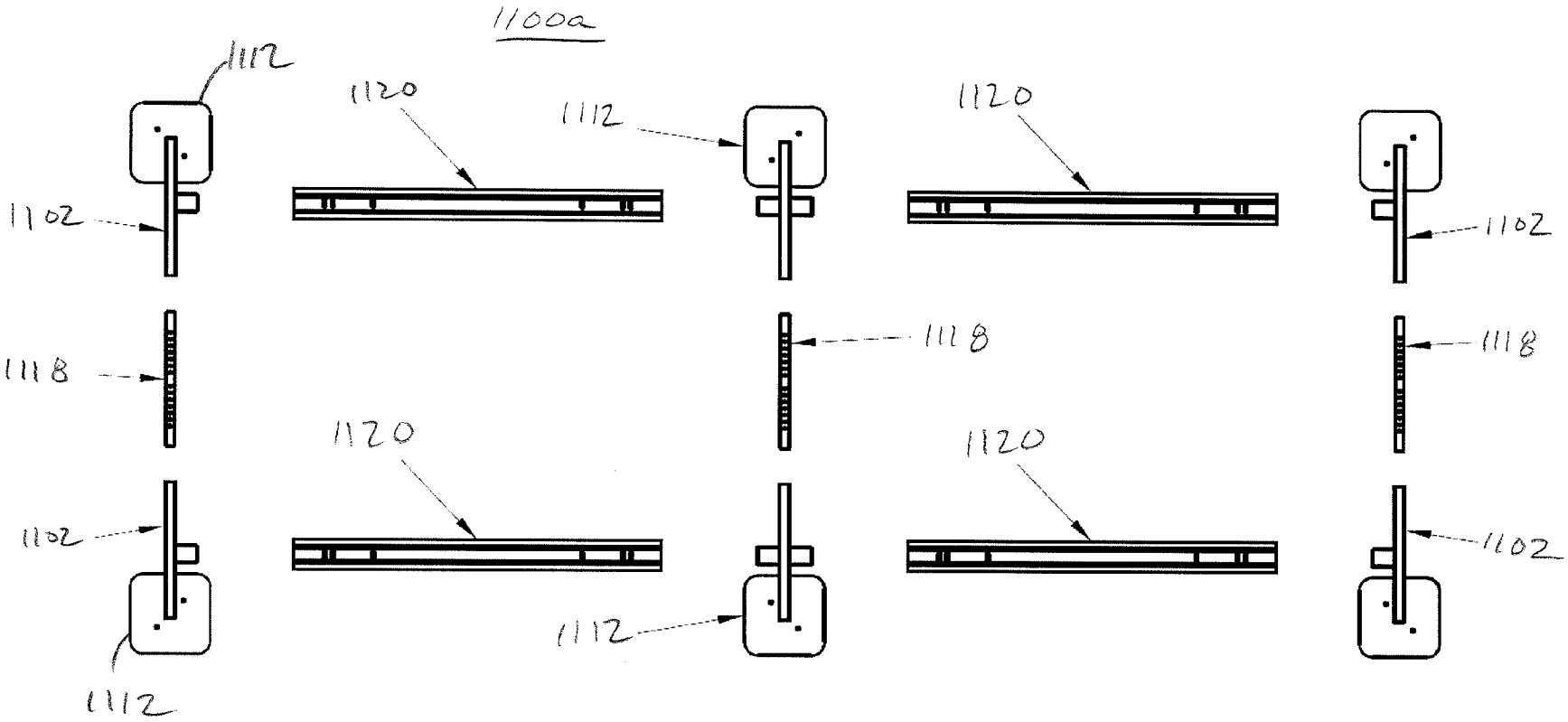
FIG. 29 is top exploded view of the embodiment appearing in FIG. 27.

FIGS. 27-29, 33, and 34 are illustrative of a second embodiment stand 1100*a* having two segments and is otherwise as described above by way of reference to FIGS. 24-26. Although the axial length of each segment in FIGS. 27-29 is the same, it will be recognized that alternative sizes may be obtained by selecting cross rails having a desired axial length for one or both of the segments. The axial length of each segment may be the same of different than the other segment.

Figure 30:
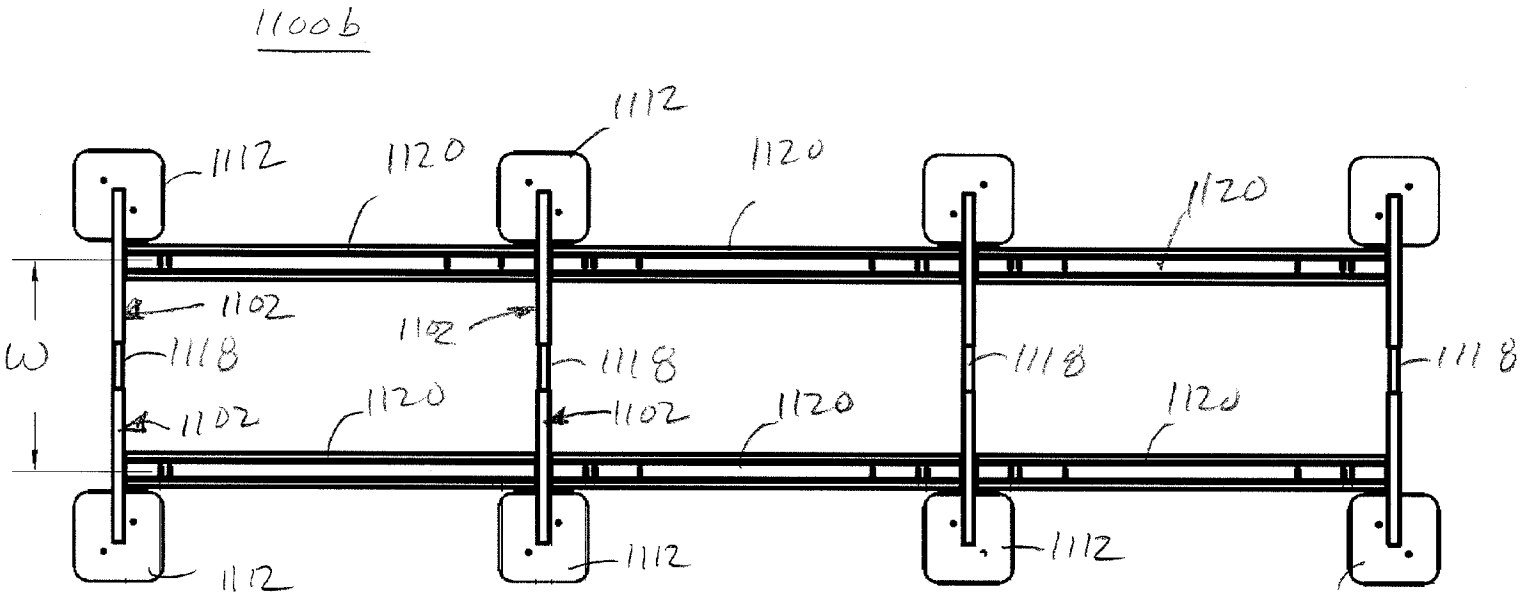
FIG. 30 is a top plan view of 3-segment an adjustable width embodiment similar to the embodiment appearing in FIG. 27.
Figure 31:
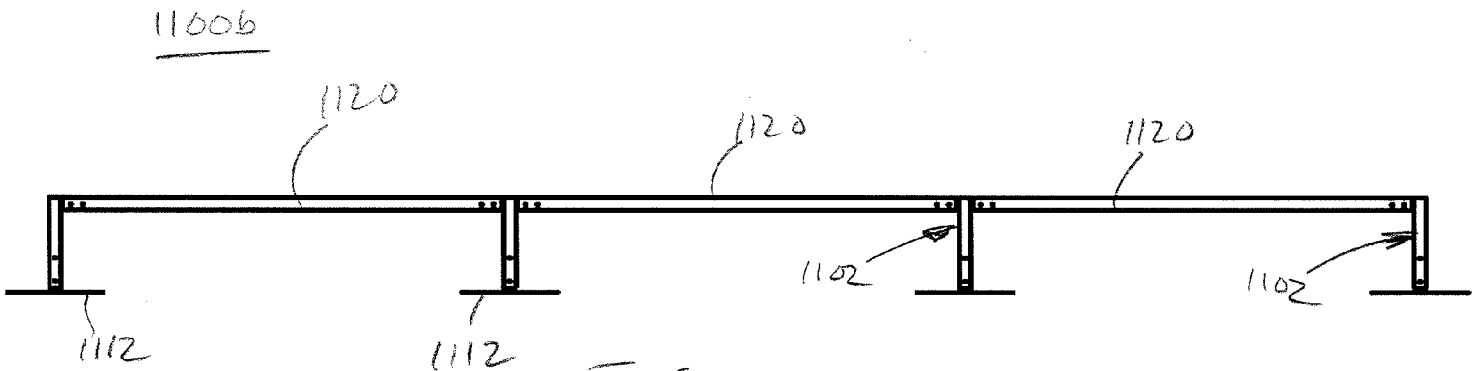
FIG. 31 is side elevational view of the embodiment appearing in FIG. 30.
Figure 32:
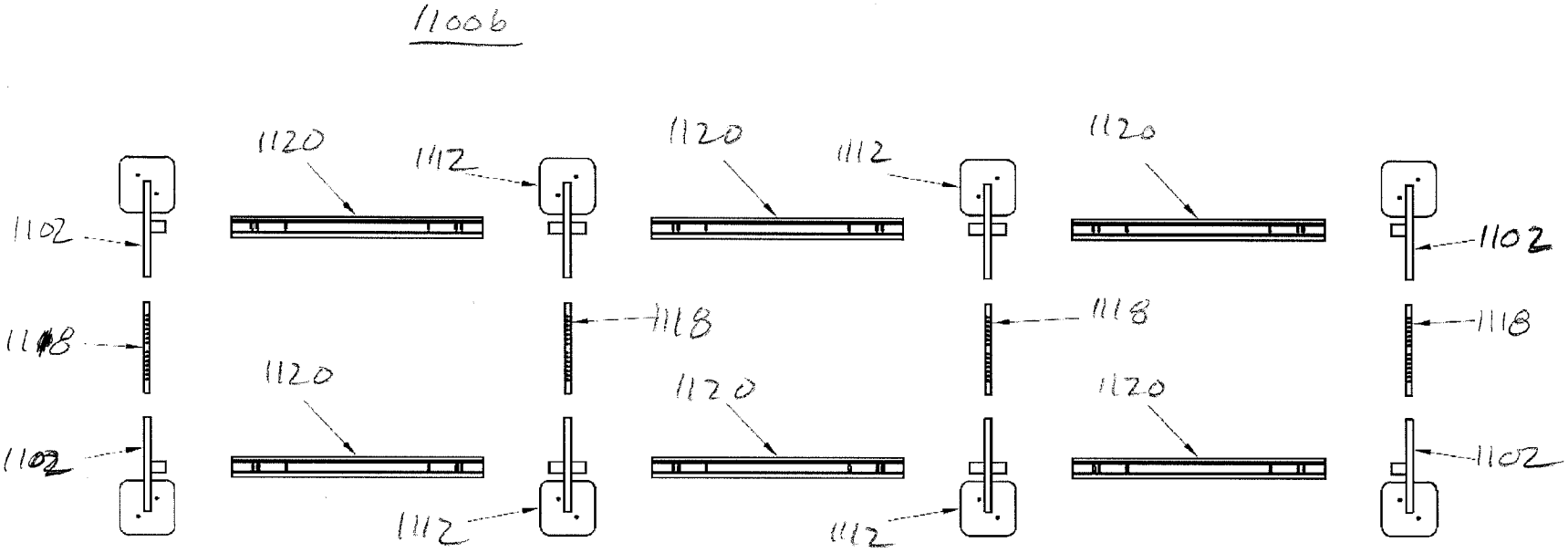
FIG. 32 is top exploded view of the embodiment appearing in FIG. 30.

FIGS. 30-34 are illustrative of a third, three-segment embodiment stand 1100*b* having three segments and is otherwise as described above by way of reference to FIGS. 24-29. Although the axial length of each segment appearing in FIGS. 30-32 is the same, it will be recognized that alternative sizes may be obtained by selecting cross rails having a desired axial length for each of the three segments. The axial length of each segment may be the same of different than the other segments.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

The invention claimed is:

1. A modular stand for supporting a modular HVAC system at an elevated position above a support surface, the modular stand having an axial dimension and a transverse dimension, the stand comprising:

a first inverted U-bar including first and second opposing leg members, each of the opposing first and second leg members including a vertical segment continuously transitioning to a horizontal segment, the first inverted U-bar including a first generally horizontal extension member, the first generally horizontal extension member having a first end telescopically received within the horizontal segment of the first opposing leg member and a second end of the first generally horizontal extension member telescopically received within the horizontal segment of the second opposing leg member;

a second inverted U-bar axially spaced apart from the inverted first U-bar, the second inverted U-bar including third and fourth opposing leg members, each of the opposing third and fourth leg members including a vertical segment continuously transitioning to a horizontal segment, the second inverted U-bar including a second generally horizontal extension member, the second generally horizontal extension member having a first end telescopically received within the horizontal segment of the third opposing leg member and a second end of the second generally horizontal extension member telescopically received within the horizontal segment of the fourth opposing leg member;

at least one support peg attached to each horizontal segment and extending in an axial direction;

first and second cross rails extending in the axial direction between the first and second inverted U-bars, the first and second cross rails transversely spaced apart from each other, the first and second cross rails each defining an inverted generally U-shaped channel;

the inverted generally U-shaped channel of the first cross rail having a first end receiving and supported on one of the at least one support peg on the first inverted U-bar and a second end receiving and supported on one of said at least one support peg on the second inverted U-bar; and the inverted generally U-shaped channel of the second cross rail having a first end receiving and supported on another one of said at least one support peg on the first inverted U-bar and a second end receiving and supported on another one of said at least one support peg on the second inverted U-bar;

wherein each of the first and second opposing leg members includes a bend having a radius of curvature between the respective vertical segment and the respective horizontal segment;

wherein each of the third and fourth opposing leg members includes a bend having a radius of curvature between the respective vertical segment and the respective horizontal segment.

2. The modular stand of claim 1, further comprising:

one or more fasteners removably securing the first end of the first cross rail to the one of said at least one support peg on the first U-bar;

one or more fasteners removably securing the second end of the first cross rail to the one of said at least one support peg on the second U-bar;

one or more fasteners removably securing the first end of the second cross rail to the other one of said at least one support peg on the first U-bar;

one or more fasteners removably securing the second end of the second cross rail to the other one of said at least one support peg on the second U-bar; and wherein the axial dimension and the transverse dimension are devised and sized to receive and support a modular HVAC system.

3. The modular stand of claim 1, further comprising:

first and second posts telescopingly received within the respective vertical segment of the opposing first and second leg members; and third and fourth posts telescopingly received within the respective vertical segment of the opposing third and fourth second leg members.

4. The modular stand of claim 3, further comprising:

a bearing plate attached to a bottom of each of the first, second, third, and fourth posts.

5. The modular stand of claim 1, further comprising:

apertures in each of the first and second cross rails configured to receive mounting hardware for removably attaching an HVAC system to the stand.

6. The modular stand of claim 1, wherein the first and second cross beams are formed of a flanged, hat-channel material.

7. The modular stand of claim 1, further comprising:

a third U-bar axially spaced apart from the second U-bar, the third U-bar including fifth and sixth opposing leg members, each of the opposing fifth and sixth leg members including a vertical segment transitioning to a horizontal segment, the third U-bar including a third generally horizontal extension member, the third generally horizontal extension member having a first end telescopically received within the horizontal segment of the fifth opposing leg member and a second end of the third generally horizontal extension member telescopically received within the horizontal segment of the sixth opposing leg member;

at least one support peg attached to the horizontal segment of the fifth opposing leg member and extending an axial direction, and at least one support peg attached to the horizontal segment of the sixth opposing leg member and extending an axial direction;

third and fourth cross rails extending in the axial direction between the second and third U-bars, the third and fourth cross rails transversely spaced apart from each other, the third and fourth cross rails each defining a channel;

the third cross rail having a first end receiving and supported on a third one of said at least one support peg on the second U-bar and a second end receiving and supported on one of said at least one support peg on the third U-bar; and the fourth cross rail having a first end receiving and supported on a fourth one of said at least one support peg on the second U-bar and a second end receiving and supported on another one of said at least one support peg on the third U-bar.

8. The modular stand of claim 7, further comprising:

one or more fasteners removably securing the first end of the third cross rail to the third one of said at least one support peg on the second U-bar;

one or more fasteners removably securing the second end of the third cross rail to the one of said at least one support peg on the third U-bar;

one or more fasteners removably securing the first end of the fourth cross rail to the fourth one of said at least one support peg on the second U-bar; and one or more fasteners removably securing the second end of the fourth cross rail to the other one of said at least one support peg on the third U-bar.

9. The modular stand of claim 7, wherein the first and second cross rails each have an axial length which is the same as an axial length of the third and fourth cross rails.

10. The modular stand of claim 7, wherein the first and second cross rails each have an axial length which is greater than an axial length of the third and fourth cross rails.

11. The modular stand of claim 7, further comprising:

a fourth U-bar axially spaced apart from the third U-bar, the fourth U-bar including seventh and eighth opposing leg members, each of the opposing seventh and eighth leg members including a vertical segment transitioning to a horizontal segment, the fourth U-bar including a fourth generally horizontal extension member, the fourth generally horizontal extension member having a first end telescopically received within the horizontal segment of the seventh opposing leg member and a second end of the fourth generally horizontal extension member telescopically received within the horizontal segment of the eighth opposing leg member;

at least one support peg attached to the horizontal segment of the seventh opposing leg member and extending an axial direction, and at least one support peg attached to the horizontal segment of the eighth opposing leg member and extending an axial direction;

fifth and sixth cross rails extending in the axial direction between the third and fourth U-bars, the seventh and eighth cross rails transversely spaced apart from each other, the fifth and sixth cross rails each defining a channel;

the fifth cross rail having a first end receiving and supported on a third one of said at least one support peg on the third U-bar and a second end receiving and supported on one of said at least one support peg on the fourth U-bar; and the sixth cross rail having a first end receiving and supported on a fourth one of said at least one support peg on the third U-bar and a second end receiving and supported on another one of said at least one support peg on the fourth U-bar.

12. The modular stand of claim 11, further comprising:

one or more fasteners removably securing the first end of the fifth cross rail to the third one of said at least one support peg on the third U-bar;

one or more fasteners removably securing the second end of the fifth cross rail to the one of said at least one support peg on the fourth U-bar;

one or more fasteners removably securing the first end of the sixth cross rail to the fourth one of said at least one support peg on the third U-bar; and one or more fasteners removably securing the second end of the sixth cross rail to the other one of said at least one support peg on the fourth U-bar.

13. A modular stand adapted to support a modular HVAC system at an elevated position above a support surface, the modular stand having an axial dimension and a transverse dimension, the stand comprising:

first and second inverted U-bars axially spaced apart from each other, each of the first and second inverted U-bars including first and second transversely spaced apart supporting legs, a generally horizontal beam extending in a transverse direction, a first bend having a radius of curvature extending from an upper end of the first supporting leg to a first end of the horizontal beam, and a second bend having a radius of curvature extending from an upper end of the second supporting leg to a second end of the horizontal beam;

a plurality of support pegs attached to and extending from each horizontal beam, each of the support pegs attached to the horizontal beam at a transverse position inward of the first and second supporting legs and extending in an axial direction;

first and second cross rails extending in the axial direction between the first and second inverted U-bars, the first and second cross rails transversely spaced apart from each other, the first and second cross rails each having an inverted generally U-shaped cross section defining a channel;

the first cross rail having a first end receiving and supported on a corresponding one of said plurality of support pegs on the first inverted U-bar and a second end receiving and supported on a corresponding one of said plurality of support pegs on the second inverted U-bar, wherein the corresponding support pegs are inserted within the channel of the first cross rail; and the second cross rail having a first end receiving and supported on another corresponding one of said plurality of support pegs on the first inverted U-bar and a second end receiving and supported on another corresponding one of said plurality of support pegs on the second inverted U-bar, wherein the corresponding support pegs are inserted within the channel of the second cross rail; wherein the horizontal beams and the first and second cross rails are configured to support the modular HVAC system, and the legs are configured to elevate the modular HVAC system above the support surface.

14. The modular stand of claim 1, wherein said modular stand is capable of being arranged in a disassembled or partially disassembled form.

* * * * *